US008833115B2

(12) United States Patent
Nakasuji

(10) Patent No.: US 8,833,115 B2
(45) Date of Patent: Sep. 16, 2014

(54) ANTITHEFT DEVICE FOR A PRODUCT DISPLAY CASE

(75) Inventor: Tamotsu Nakasuji, Ikoma (JP)

(73) Assignee: Kabushiki Kaisha San-Ei, Higashi-Osaka-shi, Osaka (JP)

( * ) Notice: Subject to any disclaimer, the term of this patent is extended or adjusted under 35 U.S.C. 154(b) by 467 days.

(21) Appl. No.: 13/129,247

(22) PCT Filed: Sep. 17, 2009

(86) PCT No.: PCT/JP2009/066223
§ 371 (c)(1),
(2), (4) Date: May 13, 2011

(87) PCT Pub. No.: WO2010/150420
PCT Pub. Date: Dec. 29, 2010

(65) Prior Publication Data

US 2011/0215683 A1 Sep. 8, 2011

(30) Foreign Application Priority Data

Jun. 22, 2009 (JP) ..... 2009-147244
Jul. 22, 2009 (JP) ..... 2009-170786

(51) Int. Cl.
*E05B 73/00* (2006.01)
*E05B 47/00* (2006.01)

(52) U.S. Cl.
CPC ..... *E05B 73/0023* (2013.01)
USPC ..... 70/57.1; 70/63; 70/276; 70/413; 206/1.5; 206/308.2; 206/387.11; 292/251.5; 340/572.8; 340/572.9

(58) Field of Classification Search
USPC ..... 70/57.1, 58, 63, 276, 413; 206/1.5, 206/308.2, 387.11; 292/80, 81, 251.5; 340/572.8, 572.9
See application file for complete search history.

(56) References Cited

U.S. PATENT DOCUMENTS

| | | | | | |
|---|---|---|---|---|---|
| 3,236,075 | A | * | 2/1966 | Williams | 70/63 |
| 4,425,771 | A | * | 1/1984 | Beach et al. | 70/276 |
| 4,993,245 | A | * | 2/1991 | Ott | 70/57.1 |
| 5,768,922 | A | * | 6/1998 | Lax | 70/276 |
| 6,125,668 | A | * | 10/2000 | Belden, Jr. | 70/57.1 |

(Continued)

FOREIGN PATENT DOCUMENTS

| | | | |
|---|---|---|---|
| JP | 10-95449 | A | 4/1998 |
| JP | 2004-1791 | A | 1/2004 |
| JP | 2007-331843 | A | 12/2007 |

*Primary Examiner* — Lloyd Gall
(74) *Attorney, Agent, or Firm* — Roberts Mlotkowski Safran & Cole, P.C.; David S. Safran

(57) ABSTRACT

An antitheft device having a product display case with a double locking mechanism and an unlocking device for unlocking the locking mechanism. A product display case having a locking mechanism, and an unlocking device are provided. An attachment portion for a security tag is provided on the inside of the product display case, and a first case component and a second case component are openably fitted together in an X direction. The locking mechanism has a first lock device and a second lock device that latch together in a Y direction which intersects the X direction. The first lock device locks by latching in a Y1 direction, and unlocks upon being pressed in a Y2 direction by a projection of the unlocking device. The second lock device locks by latching in the Y2 direction, and unlocks upon being pulled in the Y 1 direction by a magnet in the unlocking device.

15 Claims, 28 Drawing Sheets

(56) References Cited

U.S. PATENT DOCUMENTS

| | | | | |
|---|---|---|---|---|
| 6,422,387 | B1 * | 7/2002 | Sedon et al. | 206/387.11 |
| 6,598,742 | B1 * | 7/2003 | Belden et al. | 206/308.2 |
| 6,601,701 | B1 * | 8/2003 | Belden et al. | 206/387.11 |
| 7,036,659 | B2 * | 5/2006 | Mitsuyama | 206/308.2 |
| 7,194,879 | B2 * | 3/2007 | Sedon et al. | 70/57.1 |
| 7,257,971 | B2 * | 8/2007 | Lax et al. | 70/57.1 |
| 7,404,484 | B2 * | 7/2008 | Farrar et al. | 206/308.1 |
| 7,536,884 | B2 * | 5/2009 | Ho | 70/57.1 |
| 7,581,418 | B2 * | 9/2009 | Sedon et al. | 70/57.1 |
| 7,610,782 | B2 * | 11/2009 | Lax et al. | 70/57.1 |
| 7,963,131 | B2 * | 6/2011 | Zhang et al. | 70/57 |
| 8,051,686 | B2 * | 11/2011 | Garner | 70/57.1 |
| 8,151,606 | B2 * | 4/2012 | van Koot et al. | 70/57.1 |
| 8,272,238 | B2 * | 9/2012 | Chapnik | 70/57.1 |
| 8,276,410 | B2 * | 10/2012 | Sedon et al. | 70/57.1 |
| 8,281,626 | B2 * | 10/2012 | Conti et al. | 70/57.1 |
| 8,297,436 | B2 * | 10/2012 | Gattefosse et al. | 206/1.5 |
| 2003/0111367 | A1 * | 6/2003 | Lax et al. | 206/308.2 |
| 2004/0182119 | A1 * | 9/2004 | Lax et al. | 70/57.1 |
| 2005/0098455 | A1 * | 5/2005 | Hsiao et al. | 206/308.2 |
| 2005/0098463 | A1 * | 5/2005 | Belden et al. | 206/387.11 |
| 2005/0279143 | A1 * | 12/2005 | Belden et al. | 70/57.1 |
| 2006/0042330 | A1 * | 3/2006 | Lax et al. | 70/57.1 |
| 2006/0137408 | A1 * | 6/2006 | Maddox et al. | 70/57.1 |

* cited by examiner

ANTITHEFT DEVICE FOR A PRODUCT DISPLAY CASE

BACKGROUND OF THE INVENTION

1. Field of the Invention

The present invention relates to an antitheft device for a product display case to be exhibited in a store that prevents a product therein from being stolen by thieves such as shoplifters. The antitheft device comprises a locking mechanism provided in the display case for locking the same in a closed condition and a unlocking device separate from the display case which unlocks the locking mechanism to open the display case.

2. Description of Related Art

Conventionally, at various retail stores etc., a security tag is affixed to an exhibited product in order to prevent it from being stolen. If the product affixed with the security tag is being taken out the store, a detecting apparatus provided at the exit will raise an alarm for preventing the theft.

However, since the security tag is adhered to the product surface, the antitheft will not be effected if the tag is peeled off before taking the product out the store.

For this reason, products such as cosmetics in a drug store, for example, are not displayed, but only empty packing cases thereof such as paper boxes are displayed. If a customer brings the empty packing case at a checkout counter for purchasing the product, a salesclerk puts the product into the packing case and delivers it to the customer.

However, a customer usually hesitates to buy a product only by checking an empty packing case without viewing the real product.

The theft problems as mentioned above are to be solved in various stores including a rental video shop etc., and the inventor has already proposed antitheft devices for video-disc display cases. According to such antitheft device of a video-disc display case, the case is locked in a closed condition by a locking mechanism. If a customer brings the display case at a checkout counter, a salesclerk unlocks the locking mechanism by using a unlocking device to make the display case openable and then delivers it to the customer.

In case of the video-disc display case, the locking mechanism is locked by a key inserted in the display case. The key is pulled out from the case with the unlocking device which unlocks the locking mechanism. As a result, a large number of keys pulled out these cases will be piled on the checkout counter. Accordingly, there is a problem of requiring subsequent arrangement and maintenance of those keys piled on the counter.

PRIOR ART REFERENCES

Japanese patent publication-A No. 2007-331843

SUMMARY OF THE INVENTION

Problems Discovered by the Invention

According to the invention, a security tag is contained in a product display case. Therefore, if a thief pretending customer tries to take the display case out the store, a detecting apparatus at the exit will raise an alarm for preventing the theft.

The display case can be opened and closed so that a product may be put in and taken out the case. In a closed condition, the display case can be locked by a locking mechanism so as not to be opened unless an unlocking device is used. Customers may take the display case in their hands and may check the product through the case. If a customer brings the display case at the checkout counter for purchasing the product, a salesclerk opens the case by using the unlocking device and delivers the product to the customer. The empty display case, having taken out the product, may be reused at the store.

The first object of the present invention is to provide a product display case having a locking mechanism which may be locked and unlocked without using such keys as mentioned above about a video-disc display case. According to the invention, unlocking of the locking mechanism and delivery of the product become quick at a crowded checkout counter of volume sellers such as drug stores.

The above-mentioned video-disc display case needs at least such 4 operations as that the first operation to unlock the locking mechanism by using the unlocking device, the second operation to pull out the key, the third operation to open the display case and the fourth operation to take the product out the case. It cannot improve busyness at a crowded checkout counter. A large number of the keys pulled out the display cases will be piled on the checkout counter. In comparison, according to the present invention, an operation to unlock the locking mechanism by using the unlocking device and an operation to open the display case can be made almost simultaneously. Further, the product can be taken in hand by a salesclerk almost simultaneously with the opening operation of the display case. No parts such as keys are piled on the checkout counter.

The second object of the invention is to provide a product display case having a locking mechanism which makes impossible to be unlocked by thieves. In volume sellers etc., the locking mechanism may be tried to be illegally unlocked to extract the product from the display case by thieves coming one after another. Since these thieves have enough experiences and skills in unlocking a simply structured locking mechanism, it is necessary to provide a complexly structured locking mechanism.

The present invention provides a locking mechanism having a double locking mechanism which comprises lock means of projection-unlock-type and lock means of magnet-unlock-type. The lock means of projection-unlock-type can be unlocked only by a corresponding unlock projection of a unlocking device, and the lock means of magnet-unlock-type can be unlocked only by a corresponding magnet of the unlocking device. Since the product display case cannot be opened unless the lock means of both types are unlocked simultaneously, the security effect becomes very high. Although the locking mechanism forms such double locking mechanism, the unlocking device is so constructed to enable to unlock the double locking mechanism by one quick motion.

The locking mechanism of the invention is so constructed to keep the locked state permanently when a thief tries to unlock the locking mechanism by inserting a tool such as screw driver in a narrow space of the display case. Under such permanent locked state, the product can no longer be taken out unless the display case is destroyed. If the thief tries to take the display case out the store, with the locking mechanism locked, the security tag will be detected at the exit.

According to the locking mechanism of the invention, said locking means of magnet-unlock-type is provided with self-lock means. The self-lock means locks the lock means of magnet-unlock-type so as not to be unlocked, even when a shock is added to the display case or a magnet is put close to exterior of the display case. Such the locking mechanism provided with the self-lock means can be unlocked only when the unlocking device of the invention is used. The unlocking device makes it possible to unlock the self-unlock means, the lock means of projection-unlock-type and the lock means of magnet-unlock-type simultaneously.

The third object of the invention is to provide a unlocking device having a security mechanism for preventing its unauthorized use. When a theft group etc. trespasses upon a store at midnight etc., they might steal not only money or precious articles but also the unlocking device for their future use. Once the thieves have obtained the unlocking device, they would visit the store again with the device, pretending customer, and can unlock easily the locking mechanism of the product display cases exhibited in the store. As a result, products may be stolen easily.

According to the invention, the unlocking device is covered with a cover member which can be opened and closed. The unlocking device is provided with cover-lock means for locking the cover member in a closed position. By keeping and managing a key for unlocking the cover-lock means by an authorized manager, unapproved use of the unlocking device is prevented. In the event that the unlocking device is stolen and the cover member is tried to be opened or removed by a thief, the unlocking function of the device becomes destroyed and it can no longer be used for unlocking the locking mechanism of the product display cases.

Means for Solving the Problems

The invention provides a product display case having said locking mechanism, and a unlocking device for unlocking said locking mechanism.

The product display case includes a first case component and a second case component, both case components are openably closed to be fitted together to form a product holding chamber, and an attachment portion is provided in the product display case to which a security tag is attached. The locking mechanism provides a first lock of projection-unlock type and a second lock of magnet-unlock type which are arranged in a lock-structure section of the case. The first lock carries out its locking operation in a direction toward outside the display case, and the second lock means carries out its locking operation in a direction toward inside the display case, when both the case components are closed and fitted together. The first lock comprises a first latching member and a first receiving member that are provided between the first and second case components. The first latching member may be resiliently moved in said directions toward outside and inside of the display case, and the first receiving member opposes against said first latching member to catch it. The first latching member has an operation portion for receiving a pushing force which may be exerted from outside the lock-structure section toward inside of the display case. The second lock comprises a second latching member and a second receiving member that are provided between said first and second case components. The second latching member may be resiliently moved in the directions toward outside and inside of the display case, and the second receiving member opposes against the second latching member to catch it. The second latching member includes a magnetic piece which may be attracted to a magnet put close to the lock-structure section from outside. The unlocking device comprises a table and a unlock-structure section. The table may receive the product display case so that the lock-structure section may slide forward and backward with respect to said unlock-structure section. The unlock-structure section provides a unlock projection directed to said operation portion of the first lock and a magnet directed to the magnetic piece of the second lock.

The first case component is constituted by a bottom member. The second case component is constituted by a case body provided with an opening underneath thereof so that the case body may form the holding chamber visible from outside when the opening is closed by the bottom member. The lock-structure section comprises a pair of inner and outer plates provided in the case body, a space formed between the inner and outer plates, and a standing plate extended upward from the bottom member so as to be inserted in said space when the bottom member closes said opening. The first latching member and the first receiving member of the first lock are provided between the outer plate and the bottom member. The second latching member and the second receiving member of the second lock (11) are provided between the inner plate and the standing plate.

The second latching member of the second lock provides the standing plate with an arm having a hook protruding in the direction toward inside the display case so that the arm may be resiliently rocked in the directions toward outside and inside the display case. The second receiving member provides the inner plate with an opening which may catch the hook to be latched together.

The first latching member of the first lock is constituted by a movable member having an engaging portion which is separated from inside of the outer plate with a gap and may be moved forward and backward in the directions toward outside and inside the display case. The first receiving member is constituted by a hook-like member standing up at an end portion of the bottom member so that the hook-like member may be inserted in the gap and catches the engaging portion. The movable member is provided with an operation portion, and the outer plate is provided with an entrance directing to the operation portion so that the unlock projection of the unlocking device may enter the entrance.

The outer plate is attached detachably to the case body and an attachment portion is formed at an inside thereof to which the security tag is attached.

A permanent locking device is provided which locks the second lock so that the second latching member is prevented from disengaging from the second receiving member when a tool is inserted through a space of the lock-structure section and pushes the second latching member to be rocked when the first and second case components are fitted together.

According to a first embodiment of said permanent locking device of the invention, the permanent locking device comprises a projection which engages the arm and the opening with each other so that the arm is prevented from disengaging from the opening, when the arm is pushed by an inaccurate tool.

According to a second embodiment of said permanent locking device of the invention, the permanent locking device comprises a fragile hinge portion which may form breakage and prevent the arm from disengaging from the opening, when the arm is pushed to be rocked by an inaccurate tool.

It is preferred that an interrupting wall is provided underneath the arm, a lower end of the arm is positioned outside of said interrupting wall, and a guide surface is formed which inclines toward outside the display case from its lower end to its upper portion.

The second lock of magnet-unlock-type of the invention provides a self-lock device. The self-lock device provides a lock member which is resiliently movable between a locking position where the lock member prevents the second latching member from rocking toward outside the display case and a unlocking position where the lock member allows the first latching member to rock toward outside the display case. The lock member keeps the locking position. The unlocking device provides the unlock-structure section with unlocking member which moves the lock member of the self-lock device to the unlocking position.

According to a first embodiment of said self-lock device of the invention, the self-lock device provides a pair of lock members at both sides of the second latching member of the second lock. The lock members include lock portions which are movable between the locking position and the unlocking position, and resilient support members which hold the lock portions respectively at the locking position. The operation portion of the first lock is provided with a unlock actuator which extends toward inside the display case. The unlock actuator moves a pair of resilient support members to be apart from each other so that the lock portions may move to the unlocking position, when the operation portion is moved toward inside the display case by the unlock projection of the unlock-structure section.

According to a second embodiment of said self-lock device of the invention, the self-lock device provides a lock member which opposes to the second latching member of the second lock. The lock member includes a lock portion which is movable between a locking position and a unlocking position, a resilient support member which moves the lock portion toward the locking position, and a unlock actuator which makes the lock portion move to the unlocking position when the unlock actuator is pushed toward inside the display case. The unlock actuator may be moved by the unlock projection of the unlock-structure section against the resilient support member.

According to a third embodiment of said self-lock device of the invention, the self-lock device provides a lock member which is directed to a side-edge of the second latching member of the second lock. The lock member includes a lock portion which is movable between a locking position and a unlocking position, a resilient support member which moves the lock portion toward the locking position, and a unlock actuator having a magnetic piece which makes the lock portion move to the unlocking position against the resilient support member when a magnet is approached to the magnetic piece to be drawn toward the unlocking position. The unlocking device provides an extended section which includes a magnet to be approached to the magnetic piece of the self-lock device.

According to the invention, the unlocking device is provided with a security mechanism which comprises a fixing member secured to a bottom of the unlocking device by a fastener, a cover member which is connected to the fixing member via pivotal axes so as to be opened and closed, and a fix-lock which may engage the cover member and fixing member with each other. The cover member is so constructed to change its posture between a closed posture (P1) and an opened posture (P3) so that at least a front side including the unlock projection of the unlocking device is closed and opened thereby, and the cover member may be fixed by the fix-lock in the closed posture (P1). The cover member is provided with a destructing member which enters underneath the unlock projection when the cover member is positioned in the closed posture (P1). The unlock projection may be destroyed by the destructing member if the unlocking device is force to move downward from the cover member in the state that the fix-lock fixes the cover member.

The cover member is provided with a holding seat which may be laid on a the upper surface of the unlock-structure section and keeps the cover member standing in the opened posture (P3), when the cover member is positioned in the opened posture (P3).

Effect of the Invention

According to the invention, in a shop where display cases 1 containing products M are exhibited, customers can take a product display case 1 in their hands and review by looking the product M through the case 1, an effect of products exhibition becomes high.

The product display case 1 contains a security tag 17 and is locked by a locking mechanism 2 so as not to be opened unless an officially managed unlocking device 3 is used. If a thief tries to carry out a product display case outside a store, a detecting apparatus at the exit will emit an alarm for preventing the theft.

In particular, the locking mechanism 2 of the invention performs a double locking operation by a first lock 10 of projection-unlock-type and a second lock 11 of magnet-unlock-type, it has the very high security effect. The first lock 10 cannot be unlocked unless a pushing force toward inside the display case is exerted on an operation portion 12, and the second lock 11 cannot be unlocked unless a magnet drawing force toward outside the display case is exerted. And the product display case 1 cannot be opened unless the first and the second locks 10, 11 are unlocked simultaneously. Therefore, it becomes very difficult to open unjustly even by such thief as having enough experience.

Although the locking mechanism 2 constitutes such double locking mechanism having a high security effect, the invention makes it possible that the first and the second locks 10, 11 carry out the locking operation in a simple one-motion easily and simultaneously only by fitting a first case component 4 and a second case component 7 together. When unlocking is desired, the double locking mechanism carries out the unlocking operation in a simple one-motion easily and simultaneously only by sliding the display case 1 on a table 39 of the unlocking device 3. Therefore, operability is very good. When a customer brings a display case 1 at a checkout counter for the purpose of purchasing a product M, a salesclerk can open the display case 1 quickly by using the officially managed unlocking device 3. In this occasion, no parts such as keys mentioned above about the prior art are pulled out the display case, and storage of the display cases after opening is easy. The salesclerk can take out a product M almost simultaneously with opening of the display case 1. That is, the salesclerk may take the product M in hands immediately and deliver it to the customer quickly, since a upper area of the product M becomes wide opened on a bottom member 4*a*, when a salesclerk unlocks the locking mechanism 2 by using the unlocking device 3 and only lifts the case body 7*a* from the bottom member 4*a*. This contributes to improve busyness at a crowded checkout counter.

An outer plate 14, to which a security tag 17 is attached, is constituted detachably so that the security tag 17 may be replaced simply easily.

According to the invention, the second lock 11 of magnet-unlock-type provides a permanent locking device 60 which prevents a second latching member 11*a* from rocking and keeps the second latching member engaged with a second receiving member 11*b*, when the second latching member 11*a* is pushed by a tool J inserted through a gap S between the first case component 4 and the second case component 7 fitted together. Therefore, when unjust unlocking is tried by a thief who inserts a tool J in the gap S, the permanent locking device 60 functions, and the first case component 4 and the second case component 7 are locked so as not to be separated permanently. And if the thief tries to carry out the product display case 1 outside the store, the theft is detected with the security tag 17. Therefore, the security effect of theft prevention will become very high.

According to the invention, the second latching member 11*a* of the second lock 11 of magnet-unlock-type is formed with an arm 34 which may be swung in the directions outside and inside the display case and provided with a hook 35 protruding toward inside the display case. The second receiving member 11*b* is formed with an opening 36 which received the hook 35 for engagement therewith.

According to a first embodiment of the permanent locking device 60 of the invention, the permanent locking device 60*a* comprises a projection 59 which engages the arm 34 with the opening 36 to prevent the arm 34 from being rocked toward outside the display case, when the arm 34 is pushed by a tool J toward inside the display case. As a result, when a thief inserts a tool J through the gap S and pushes the arm 34, the permanent locking means 60*a* functions by a catching operation of the projection 59 so that the second lock 11 of magnet-unlock-type can no longer be unlocked permanently.

According to a second embodiment of the permanent locking device 60 of the invention, the permanent locking device 60*b* comprises a fragile hinge portion 57 which is destroyed and prevents the arm 34 from rocking toward outside the display case, when the arm 34 is pushed by a tool J in the Y2 direction. As a result, when a thief inserts a tool J through the gap S and pushes the arm 34 toward inside the display case, the permanent locking device 60*b* functions by destroying the fragile hinge portion 57 so that the second lock 11 of magnet-unlock-type can no longer be unlocked permanently.

According to the invention, an interrupting wall 54 is formed adjacent to underneath the arm 34, and the arm 34 is so constituted that a lower end of the atm 34 meets the interrupting wall 54, and the arm 34 provides a guide surface 58 which inclines toward outside the display case from its lower end to upper portion and which forms inducing means 62. When a thief inserts a tool J through the gap S and explores by the tool J around the interrupting wall 54, the tool J is guided to the lower end of the arm 34 by the guide surface 58. Then, if the tool J moves to push the arm 34 toward inside the display case, the permanent locking device 60 functions.

According to the invention, the second lock 11 of magnet-unlock-type is provided with self-lock device 63. The self-lock device 63 includes a lock member 64 which is movable between a locking position and a unlocking position and which is usually held to keep the locking position. In the locking position, the lock member prevents the second latching member 11*a* from being moved in the direction of disengagement, and in the unlocking position, the lock member allows the second latching member 11*a* move in the direction of disengagement. Accordingly, the second latching member 11*a* is kept latched on the second receiving member 11*b* without possibility of unlatching, even when a strong shock, such as dropping the display case 1 on a floor, is given. Thereby, the locking state of the second lock 11 is guaranteed.

As a result, even when a magnet is put close to the exterior by a thief, the second latching member 11*a* cannot move back from the second receiving member 11*b*, unless the lock member 64 is moved to the unlocking position. Therefore, unjust unlocking becomes difficult and an effect of antitheft becomes high.

On the other hand, since the unlocking device 3 is provided with unlocking means 47 for unlocking the self-lock device 63 and a magnet 42 for unlocking the second lock 11 of magnet-unlock-type, the product display case 1 can be opened by one quick motion when an authorized salesclerk uses the unlocking device 3.

The unlocking device 3 of the invention is provided with a security mechanism 81. The security mechanism 81 comprises a fixing member 82 to be attached to the bottom of the unlocking device 3 by a fastener 92, a cover member 83 connected pivotally to the fixing member 82 by pivotal axes 85, and fix-lock 84 for locking the cover member 83 to the fixing member 82. The unlock-structure section 40 is opened to be available for use to unlock the locking mechanism 2 of the product display case 1, when the cover member 82 is positioned in the opened posture P3. The unlock-structure section 40 is closed, when the cover member 82 is positioned in the closed posture P1 and is locked by the fix-lock 84. By managing the key 94 of the fix-lock 84 in the authorized salesclerk's hands, unapproved use of the unlocking device 3 is prevented.

According to the invention, the cover member 83 is provided with destructing member 101 which enters underneath the unlock projection(s) 41 when the cover member positions in the closed posture P1. The destructing member 101 destroys the projection(s) 41, if the unlocking device 3 is pulled apart downward from the cover member 83 while the fix-lock 84 is locked. The unlocking device 3 cannot be used, even if it is stolen, when a thief tries to remove the security mechanism 81 form the unlocking device 3. As a result, criminal use of the stolen unlocking device 3 may be prevented.

The cover member 83 is provided with a holding seat 102. When the cover member 83, in the opened posture P3, opens the unlock-structure section 40 including the upper surface 40*c* thereof; the cover member 83 is kept standing in the opened posture P3 by putting the holding seat 102 on the upper surface 40*c*.

Preferred embodiments of the invention are described in detail by referring to drawings.

BRIEF DESCRIPTION OF THE DRAWINGS

FIG. 1 (A) is a perspective view showing a front side of a product display case in a closed and locked state, FIG. 1 (B) is a perspective view showing a rear side of the product display case, and FIG. 1 (C) is a perspective view showing a unlocking device.

FIG. 4 (A) is a perspective view showing an outside of the outer plate, FIG. 4 (B) is a perspective view showing an inside of the outer plate, and FIG. 4 (C) is a perspective view showing the inside of the outer plate in which a first latching member and operation portions for unlatching thereof with respect to a first lock means of projection-unlock-type are provided.

FIG. 9 shows an operation of the first lock means and the second lock means when the first case component and the second case component are fitted in; FIG. 9 (A) is a cross sectional view showing the state before the components are fitted in, and FIG. 9 (B) is a cross sectional view showing the state after the components are fitted in.

FIG. 11 (A) is a cross sectional view showing the state that the first lock means of projection-unlock-type is unlocked by a thief, and FIG. 11 (B) shows a cross sectional view showing the state that the permanent locking means is functioned by a tool inserted by a thief.

FIG. 14 (A) is a perspective view showing a process of unlocking, and FIG. 14 (B) is a perspective view showing a state that the second latching member of the second lock means is rocked.

FIG. 15 (A) is a perspective view showing a unlock actuator provided in the outer plate, and FIG. 15 (B) is an enlarged perspective view showing the same.

FIG. 16 shows an operation of the first embodiment of the self-lock means when the first case component and the second case component are fitted in; FIG. 16 (A) is a cross sectional view showing the state before the components are fitted in, and FIG. 16 (B) is a cross sectional view showing the state after the components are fitted in.

FIG. 18 (A) is a perspective view showing an outside of the outer plate, and FIG. 18 (B) is a perspective view showing an inside of the outer plate.

FIG. 20 shows an operation of the second embodiment of the self-lock means when the first case component and the second case component are fitted in; FIG. 20 (A) is a cross sectional view showing the state before the components are fitted in, and FIG. 20 (B) is a cross sectional view showing the state after the components are fitted in.

FIG. 23 (A) is a perspective view showing the state that a lock member is positioned in the locking position, and FIG. 23 (B) is a perspective view showing the state that the lock member is positioned in the unlocking position.

FIG. 26 (A) is a perspective view showing the cover member positioned in the opened posture, and FIG. 26 (B) is a perspective view showing the cover member positioned in the closed posture.

FIG. 27 (A) is a cross sectional view showing the cover member positioned in the closed posture, FIG. 27 (B) is a cross sectional view showing the cover member positioned in the standby posture, and FIG. 27 (C) is a cross sectional view showing the cover member positioned in the opened posture.

FIG. 28 (A) is a cross sectional view showing the cover member fixed and locked in the closed posture, and FIG. 28 (B) and FIG. 28 (C) are cross sectional views showing the state that the unlocking device is pulled down from the cover member after removing the fastener means.

PREFERRED EMBODIMENTS OF THE INVENTION

Figure 1A:
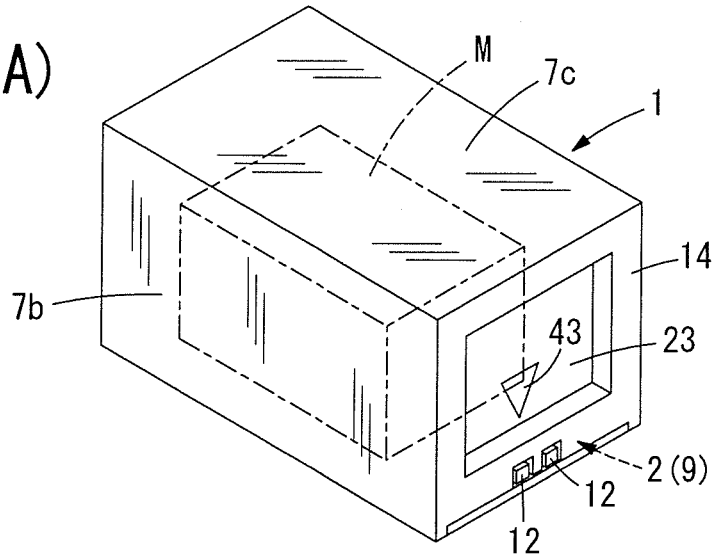
FIG. 1 shows a first embodiment of an antitheft device according to the invention.
Figure 1B:
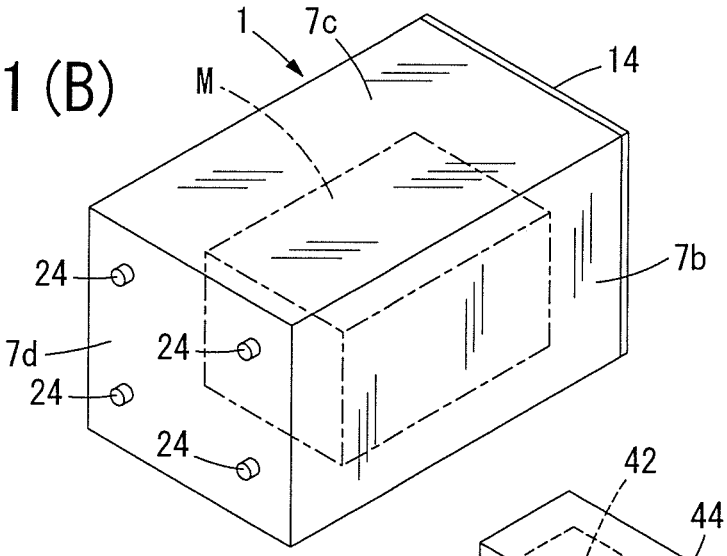
Figure 1C:
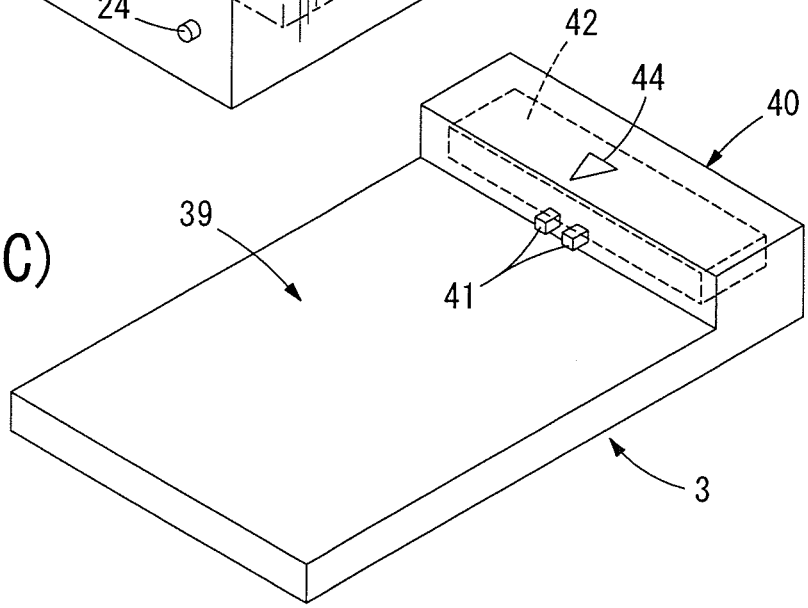

As shown in FIG. 1, an antitheft device of the invention comprises a product display case 1 provided with a locking mechanism 2, and a unlocking device 3 separate from the display case.

Figure 2:
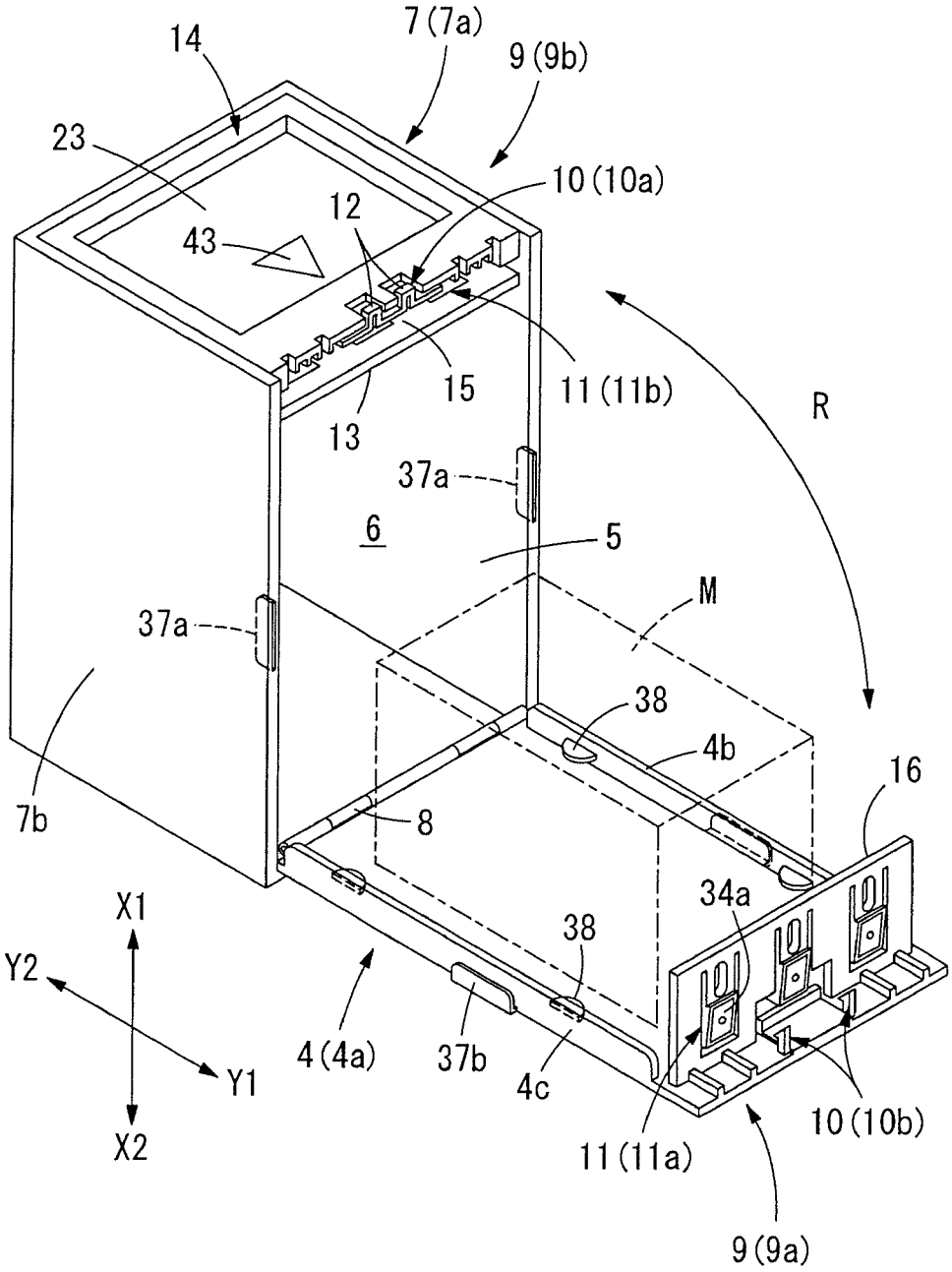
FIG. 2 is a perspective view showing the product display case in an opened state.

As shown in FIG. 2, the product display case 1 comprises a first case component 4 including a bottom member 4*a* which may receive a product M, and a second case component 7 including a case body 7*a* which provides a product holding chamber 6 having an opening 5 underneath so that the chamber 6 may surround the product M to be visible from outside. The case body 7*a* and the bottom member 4*a* may be closed and fitted together by moving the case body 7*a* in a up-and-down direction, i.e., in an X direction as shown. When the second case component 7 moves in an X1 direction (in a upward direction apart from the first case component 4 as shown), the upper area of the first case component 4 opens. When the second case component 7 moves in an X2 direction (in a downward direction toward the first case component 4 as shown) to be fitted in together with the first case component 4, the chamber 6 is positioned on the upper area of the first case component 4. In order to make the product M in the chamber 6 visible from outside, the first and second case components 4 and 7 are formed transparent as a whole or at least partially by a synthetic resin. It is preferred to form the first and second case components 4 and 7 respectively with a hard resin, such as polycarbonate. In the illustrated embodiment, the case body 7 is fowled in a substantially rectangular parallelepiped shape, and the bottom member 4*a* is formed in a substantially flat plate shape to be positioned horizontally. The respective ends of the bottom member 4*a* and the case body 7 are connected pivotally by hinge means 8 to be rotated as shown by an arrow R in the embodiment, so that the case body 7 may move in the up-and-down direction to be closed and fitted in together with the bottom member 4*a*. The arrangement is not restricted to the illustrated embodiment. The hinge means 8 may be designed to be detachable. Further, the bottom member 4*a* and the case body 7 may be constituted so that they are separate from each other and may be closed and fitted together without providing hinge means.

The product display case 1 provides a lock-structure section 9 at a front portion thereof with respect to a Y direction which intersects the X direction. The lock-structure section 9 comprises a first lock-structure section 9*a* and the second lock-structure section 9*b* which are respectively provided in the first and second case components 4 and 7 as shown in FIG. 2. The lock-structure section 9 includes a locking mechanism 2 which carries out a locking function in both directions of Y, i.e., in a Y1 direction toward outside and a Y2 direction toward inside of the display case under the condition that the first and second case components are closed and fitted together. The locking mechanism 2 constitutes a double locking mechanism by a first lock means 10 of projection-unlock-type and a second lock means 11 of magnet-unlock-type.

The first lock means 10 comprises a first latching member 10*a* and a first receiving member 10*b* which are provided between said first and second case components 4 and 7. The first latching member 10*a* can be moved by swinging or rocking in the Y direction but may be restored with its resiliency in the Y1 direction. The first receiving member 10*b* opposes against the Y1 direction and catches the first latching member 10*a*.

The second lock means 11 comprises a second latching member 11*a* and a second receiving member 11*b* which are provided between said first and second case components 4 and 7. The second latching member 11*a* can be moved by swinging or rocking in the Y direction but may be restored with its resiliency in the Y2 direction. The second receiving member 11*b* opposes against the Y2 direction and catches the second latching member 11*a*. The second latching member 11*a* has a magnetic piece 34*a* which may be drawn to a magnet when the magnet is put close to the lock-structure section 9 from outside.

The lock structure section 9 comprises a pair of inner and outer plates 13, 14 provided in the second case component 7, a space 15 formed between the inner and outer plates 13, 14, and a standing plate 16 extending upward from the bottom member 4*a* so as to be inserted in the space 15 with respect to the X direction. The first latching member 10*a* and the first receiving member 10*b* are provided between the outer plate 14 and the bottom member 4*a* to form the first lock means 10. The second latching member 11*a* and the second receiving member 11*b* are provided between the inner plate 13 and the standing plate 16 to form the second lock means 11.

Figure 3:
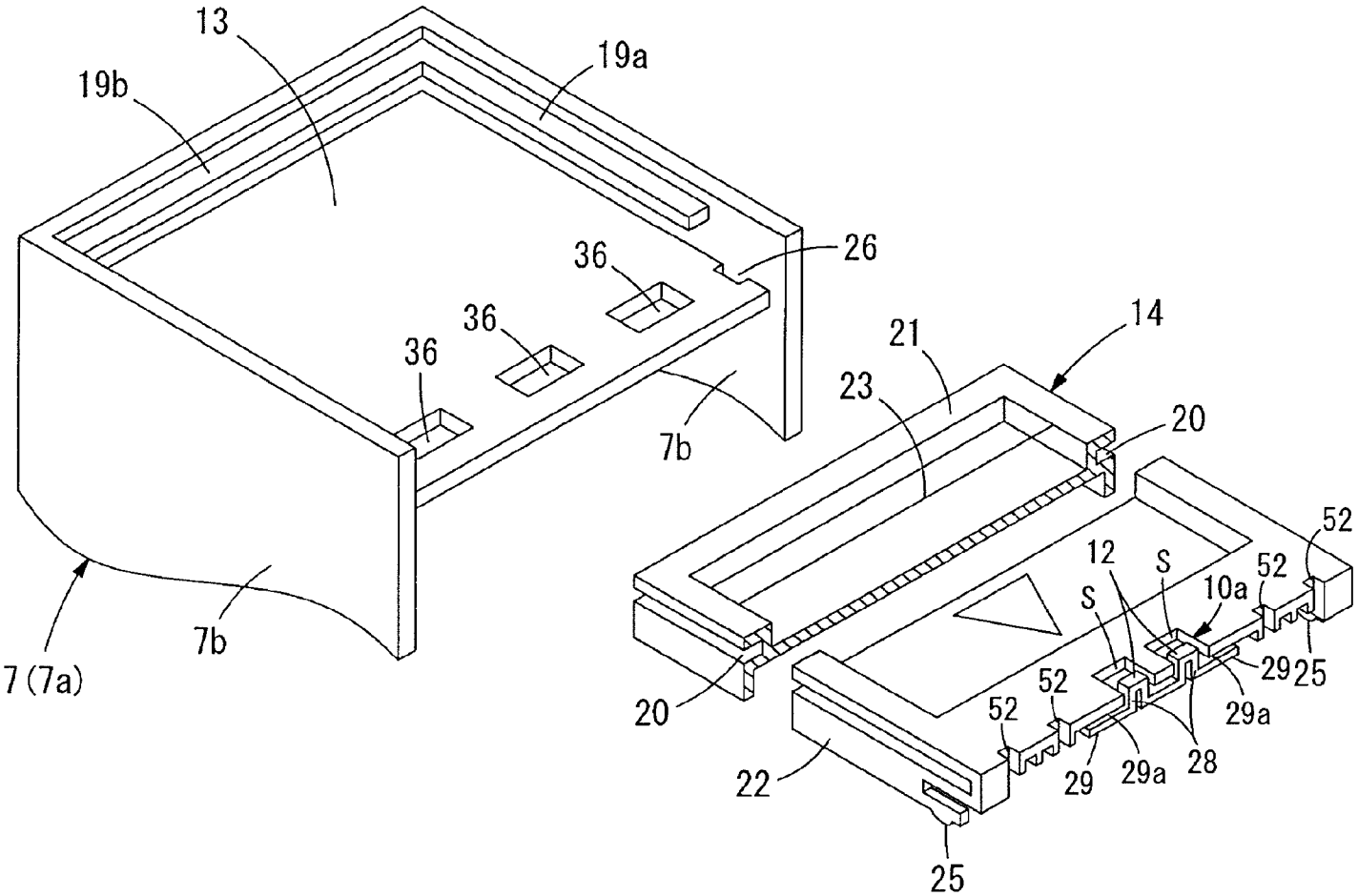
FIG. 3 is a perspective view showing an outer plate separated from the product display case.
Figure 4A:
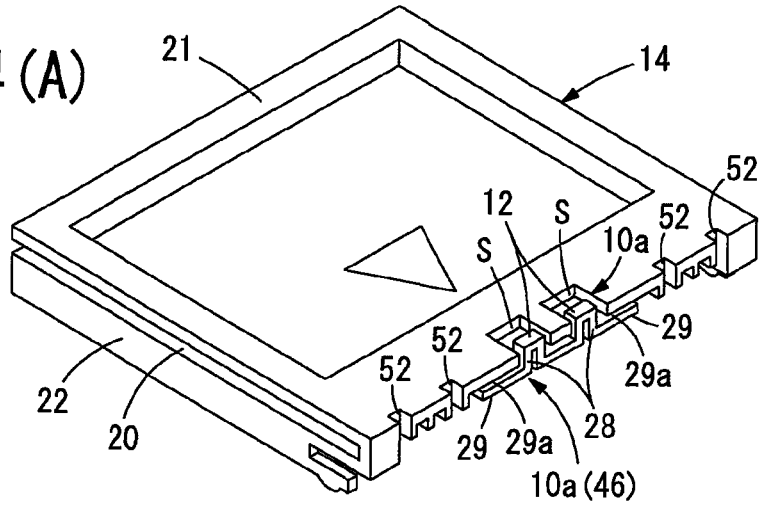
FIG. 4 shows the outer plate.
Figure 4B:
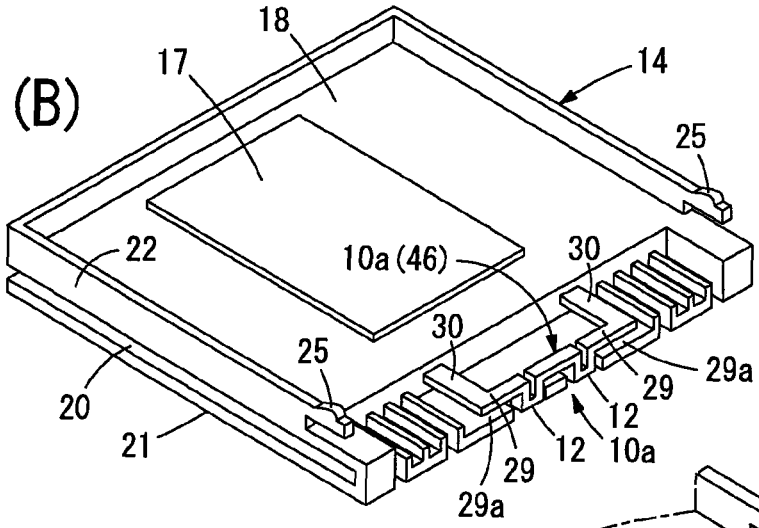
Figure 4C:
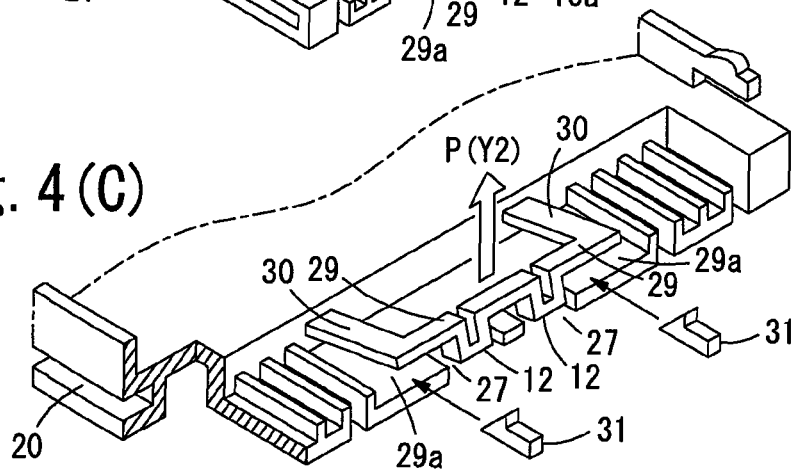

As shown in FIG. 3 and FIG. 4, the outer plate 14 is attached detachably to the case body 7. An attachment portion 18 is fanned on the inside of the outer plate 14 to which a security tag 17 is attached. The security tag 17 is stuck on the attachment portion 18 with an adhesive or the like which may be peeled off for replacement.

In the illustrated embodiment, ribs 19*a*, 19*a* and 19*b* are formed to extend along insides of side-walls 7*b*, 7*b* and a upper wall 7*c* of the case body 7*a* at the front side thereof. The inner plate 13 is provided at inside of the case body 7*a* so that the space 15 is formed between the inner and outer plates 13, 14. The outer plate 14 forms a groove 20 which extends along its three sides so that the ribs 19*a*, 19*a*, and 19*b* are inserted slidably therein. The outer plate 14 provides a plate wall 21 and a frame wall 22 which are located at outside and inside of the ribs respectively. The frame wall 22 is slidably mounted on the inner plate 13.

The plate wall 21 forms a concave 23 dented from the outer surface thereof to the vicinity of the frame wall 22. Corresponding to the concave 23, projections 24 are provided on the outer surface of a rear wall 7*d* of the case body 7*a*. In a state that the outer plate 14 is attached to the case body 7*a*, the product display case 1 is closed in such manner that the bottom member 4*a* and the case body 7*a* are fitted together. Two or more display cases 1 may be piled by engaging the projections 24 of one case 1 with the concave 23 of another case 1. In the illustrated example, four projections 24 are provided to engage with four corners of the concave 23.

The outer plate 14 provides both sides of the end of the frame wall 22 with arms 25 having bulges. The inner plate 13 provides apertures 26 at the portions corresponding to the bulges of the arms 25. With respect to the ribs 19*a*, 19*a* and 19*b*, the plate wall 21 is positioned outside and the frame wall 22 is positioned inside. The outer plate 14 is attached in such manner that the ribs 19*a*, 19*a* and 19*b* are inserted in the groove 20 by sliding movement of the outer plate 14. The outer plate 14 is secured so as not to be pulled out by engaging the bulges of the arms 25 with the apertures 26. The bulges of the arms 25 may be disengaged from the apertures 26 by inserting a needle or the like into the apertures 26 from inside of the inner plate 13 (i.e., from the chamber 6). Then, the outer plate 14 may be pulled out. Accordingly, the security tag 17 may be replaced by a new one at a store where the display case 1 is used.

Since the space 15 foiled between the inner and outer plates 13, 14 opens in the same X direction as the opening 5 of the chamber 6 opens, when the case body 7*a* (the second case component 7) and the bottom member 4*a* (the first case component 4) are closed and fitted together, the standing plate 16 is inserted in the space 15 so that the locking operations of the first lock means 10 and the second lock means 11 are carried out at the same time.

(First Lock Means of Projection-Unlock-Type)

The first lock means 10 of projection-unlock-type provides the outer plate 14 with the first latching member 10*a*. As shown in FIG. 4, the plate wall 21 forms entrances 27 of cutout shape in the edge portion thereof which defines the opening of the space 15 (see FIG. 4 (C)). The first latching member 10*a* comprises a movable member 46 which is formed integrally with the outer plate 14 by a synthetic resin. The movable member 46 provides operation portions 12, 12 located at the entrances 27, 27, legs 28, 28 extended inward from the operation portions 12, 12, engaging portions 29, 29 extended from the legs 28, 28 toward both sides thereof, and rocking arms 30, 30 which support the engaging portions 29, 29 to be moved. Gaps 29*a* are formed between the engaging portions 29 and the plate wall 21. The resilient arms 30, 30 hold the engaging portions 29, 29 in a position to form narrow gaps 29*a*, 29*a*. The gaps 29*a* will be enlarged by movement of the arms 30, 30 as shown in FIG. 4 (C), when a pushing force P is exerted through the entrances 27 on the operation portions 12 from outside of the outer plate 14 toward inside (the Y2 direction as mentioned above). The gaps 29*a* will be again narrowed by return movement of the resilient arms 30, 30, when the pushing force P is canceled.

Figure 5:
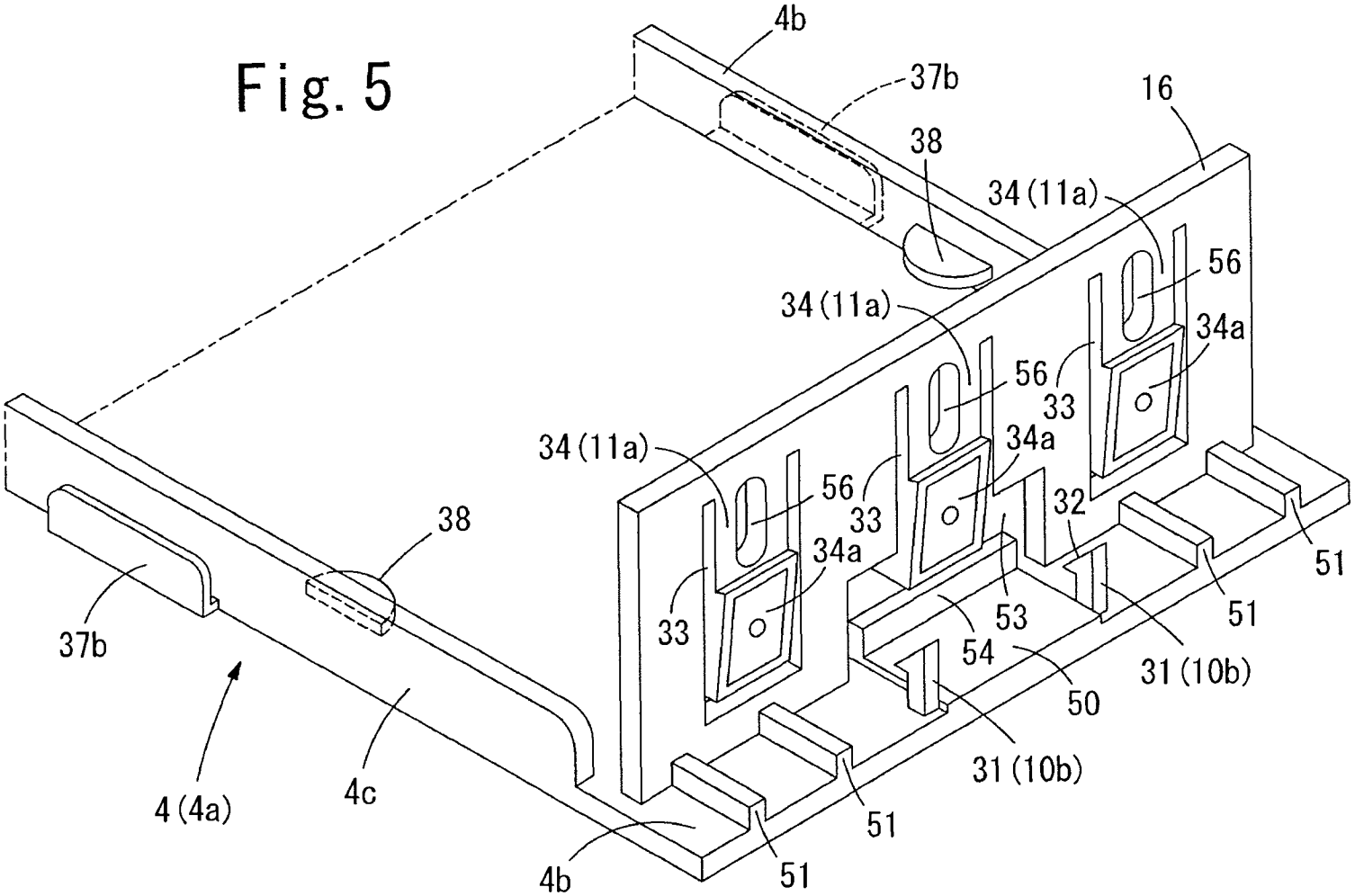
FIG. 5 is a perspective view showing a front side of a standing plate of a first case component in which hook-like members forming a first receiving member of the first locking means, and arms forming a second latching member of a second lock means are shown.

As shown in FIG. 5, the first receiving member 10*b* of the first lock means 10 comprises a pair of hook-like members 31, 31 which are extended from the end portion 4*b* of the bottom member 4*a* adjacent to the standing plate 16. The hook-like members 31, 31 provide hooks 32 having tapered guides 32*a*. When the bottom member 4*a* and the case body 7*a* are closed and fitted together, the tapered guides of the hooks 32 widen the gaps 29*a* during insertion operation thereof. When the hook-like members 31 are completely inserted in the gaps 29*a*, the engaging portions 29 are engaged with the hooks 32 upon return movement of the resilient rocking arms 30.

By means of latching the hooks 32 to the engaging portions 29, the first lock means 10 locks the bottom member 4*a* and the case body 7*a* with each other so as not to be opened in such one quick manner that the bottom member 4*a* and the case body 7*a* are only closed and fitted together. The first lock means 10 becomes unlocked upon receipt of a pushing force P on the operation portion 12. Then, the bottom member 4*a* and the case body 7*a* may be opened.

In the illustrated embodiment, the first lock means 10 provides the first latching member 10*a* in the outer plate 14 and the first receiving member 10*b* in the bottom member 4*a*, however, these members 10*a* and 10*b* may be provided in the bottom member 4*a* and the outer plate 14 conversely. Although the illustrated embodiment shows a pair of engaging means 29, 29 and a pair of hook-like members 31, 31, the number is not essential.

As shown in FIG. 5, a bulged thick portion 50 is formed on the end portion 4*b* of the bottom member 4*a* between the hook-like members 31, 31. When the bottom member 4*a* and the case body 7*a* are closed and fitted together, the thick portion 50 comes in close to the operation portions 12, 12 so as not to cause any substantial gaps therebetween. Plural ribs 51 are formed on the end portion 4*b* at both sides of the thick portion 50. The ribs 51 are inserted fitly in grooves 52 (see FIG. 4 (A)), when the bottom member 4*a* and the case body 7*a* are closed and fitted together.

Figure 7:
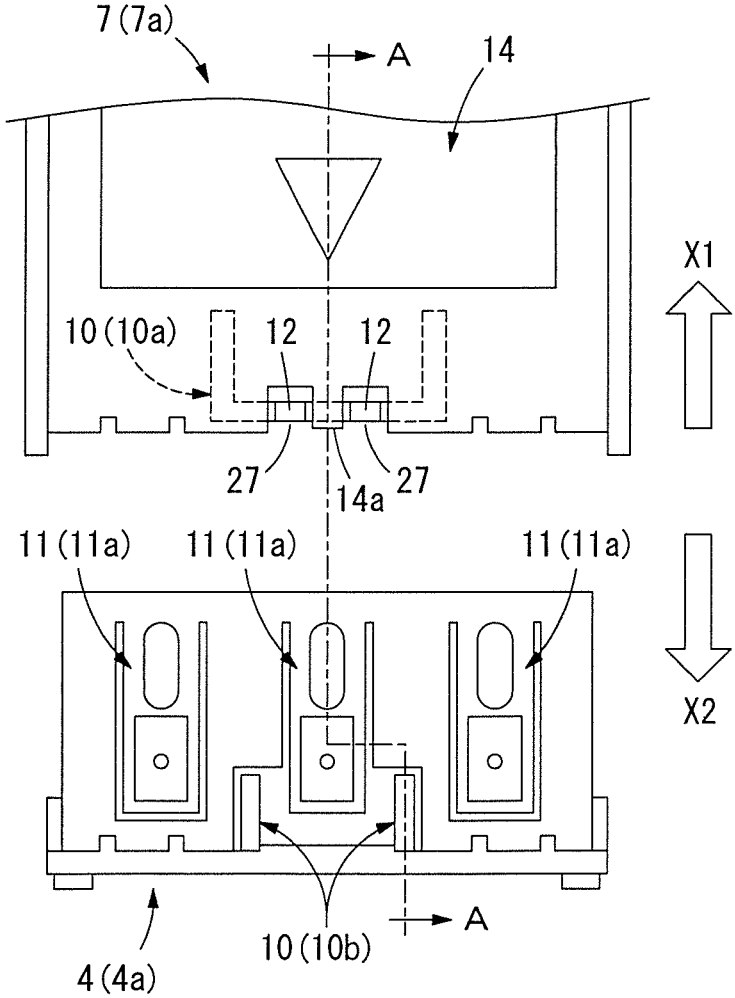
FIG. 7 is a front view showing the first case component and the second case component separated from each other.

The outer plate 14 forms a pair of entrances 27, 27 of cutout shape which receive the operation portions 12, 12. A tooth 14*a* is provided between the entrances 27, 27 as shown in FIG. 7. When the first case component 4 and the second case component 7 are closed and fitted together, both sides of the thick portion 50 fit in the respective side edges of the entrances 27, 27, and the tooth 14*a* abuts on the upper surface of the thick portion 50.

Gaps S are caused between the operation portions 12 and opening edges of the entrances 27, since the outer plate 14 is formed integrally with a synthetic resin by molds.

(Second Lock Means of Magnet-Unlock-Type)

Figure 6:
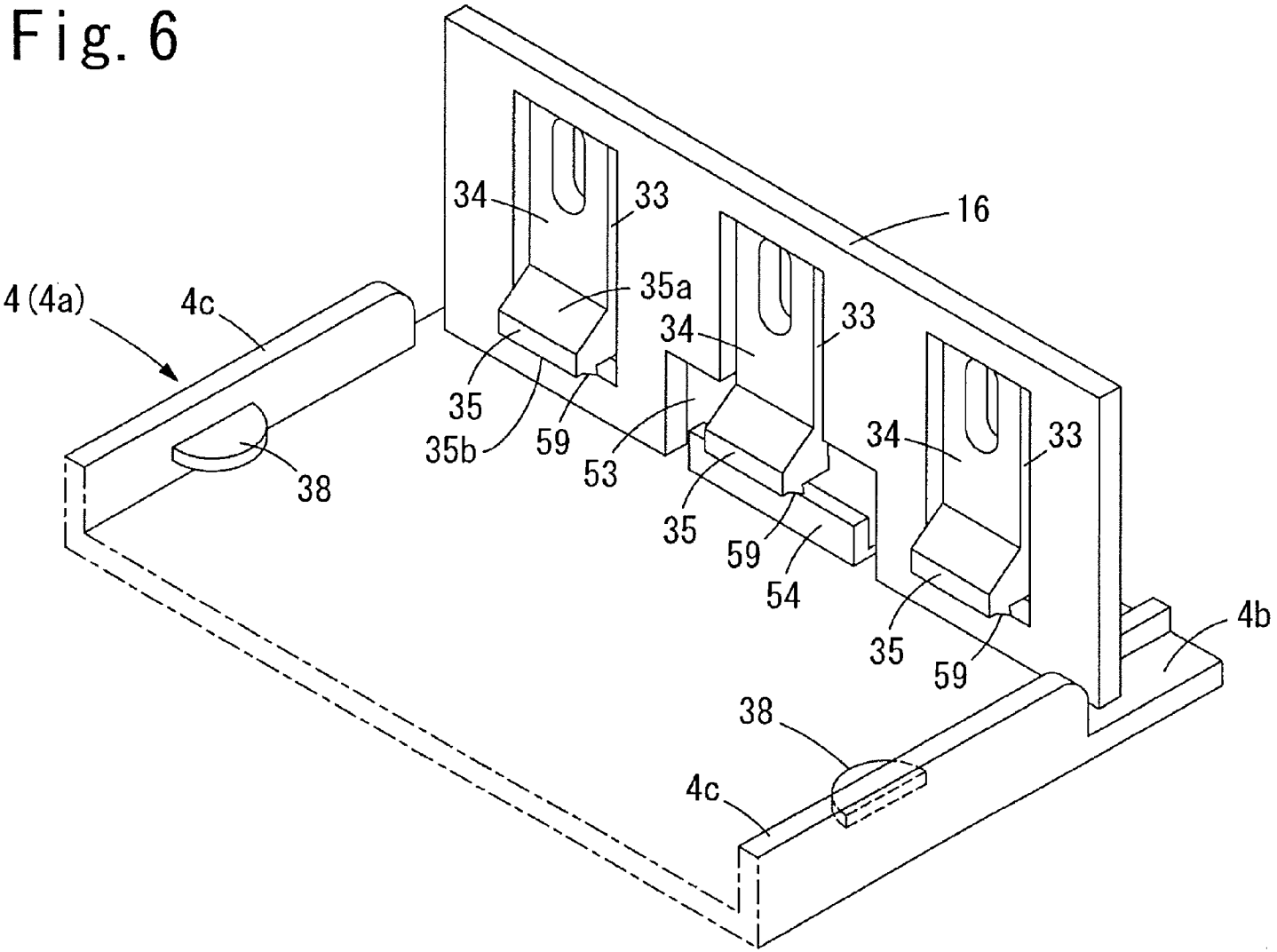
FIG. 6 is a perspective view showing a rear side of the standing plate of the first case component.

The second lock means 11 of magnet-unlock-type provides the standing plate 16 with three second latching members 11*a* arranged in parallel. As shown in FIG. 5 and FIG. 6, the second latching member 11*a* forms a slit 33 in a U-shape and provides an arm 34 surrounded thereby which may be moved by swinging or rocking. The arm 34 provides its lower free end with a hook 35 protruding inside (protruding in the Y2 direction), and provides the opposite side of the hook 35 (the portion toward the Y1 direction) with a magnetic piece 34*a* such as an iron piece. The arm 34 is restored with its resiliency in the same direction as the protruding direction of the hook 35 (in the Y2 direction), and may be moved by swinging or rocking against the resiliency in the direction of moving the hook 35 out the slit 33 (in the Y1 direction) when a magnet is approached to outside the outer plate 14.

As shown in FIG. 5, the slit 33 surrounding the center arm 34 is extended to form a wide space 53 which opens both sides and lower side of the center arm 34. An interrupting wall 54 is extended from the thick portion 50 to enter in the wide space 53.

The receiving member 11*b* of the second lock means 11 comprises three openings 36 formed in the inner plate 13 as shown in FIG. 3. When the bottom member 4*a* and the case body 7*a* are closed and fitted together, the standing plate 16 is inserted in the space 15 and the inner plate 13 moves along the standing plate 16. The hook 35 forms a tapered guide 35*a* for receiving an end edge of the inner plate 13. Accordingly, upon pushing each tapered guide 35*a* of the arms 34 by the end edge of the inner plate 13, the arms 34 move against the resiliency thereof. The hooks 35 enter in the openings 36 by return movement of the resilient arms 34, and then each engaging surface 35*b* of the hooks is engaged with each edge of the openings 36.

By means of latching the hooks 35 to the openings 36, the second lock means 11 locks the bottom member 4*a* and the case body 7*a* with each other so as not to be opened in such one quick manner that the bottom member 4*a* and the case body 7*a* are only closed and fitted together. The second lock means 11 unlocks upon receipt of a magnet from outside thereof so that the bottom member 4*a* and the case body 7*a* may be opened.

In the illustrated embodiment, the second lock means 11 comprises the second latching member 11*a* of the standing plate 16 and the second receiving member 11*b* of the inner plate 13, however, these members 11*a* and 11*b* may be provided in the inner plate 13 and the standing plate 16 conversely. The illustrated embodiment shows three hooks 35 and three openings 36, but the number is not essential.

As shown in FIG. 2, the bottom member 4*a* forms rib-like walls 4*c*, 4*c* standing at both side edges thereof so that the rib-like walls 4*c*, 4*c* may be fitted insides of the side walls 7*b*, 7*b*. In addition to such fitting construction, the side walls 7*b*, 7*b* of the case body 7*a* form slits 37*a*, 37*a* at respective edges thereof, and the bottom member 4*a* provides tongues 37*b*, 37*b* which may fit in the slits 37*a*, 37*a*. Since the bottom member 4*a* and the case body 7*a* are closed and fitted together with the tongues 37*b* inserted in the slits 37*a*, the side walls 7*b*, 7*b* are prevented from being deformed toward both sides, even when a thief tries to widen any gaps at the opening 5 by inserting a thin tool therein.

In the illustrated embodiment, the bottom member 4*a* provides holding projections 38 which protrude toward inside from the rib-like walls 4*c*, 4*c*.

When a sheet-like information material such as a leaflet, a card or the like, which describes information of the product, is put on the bottom member 4*a*, it is held by the holding projections 38 so as not to be moved. A product M will be laid on the information material in this case.

Permanent Locking Means

Figure 8:
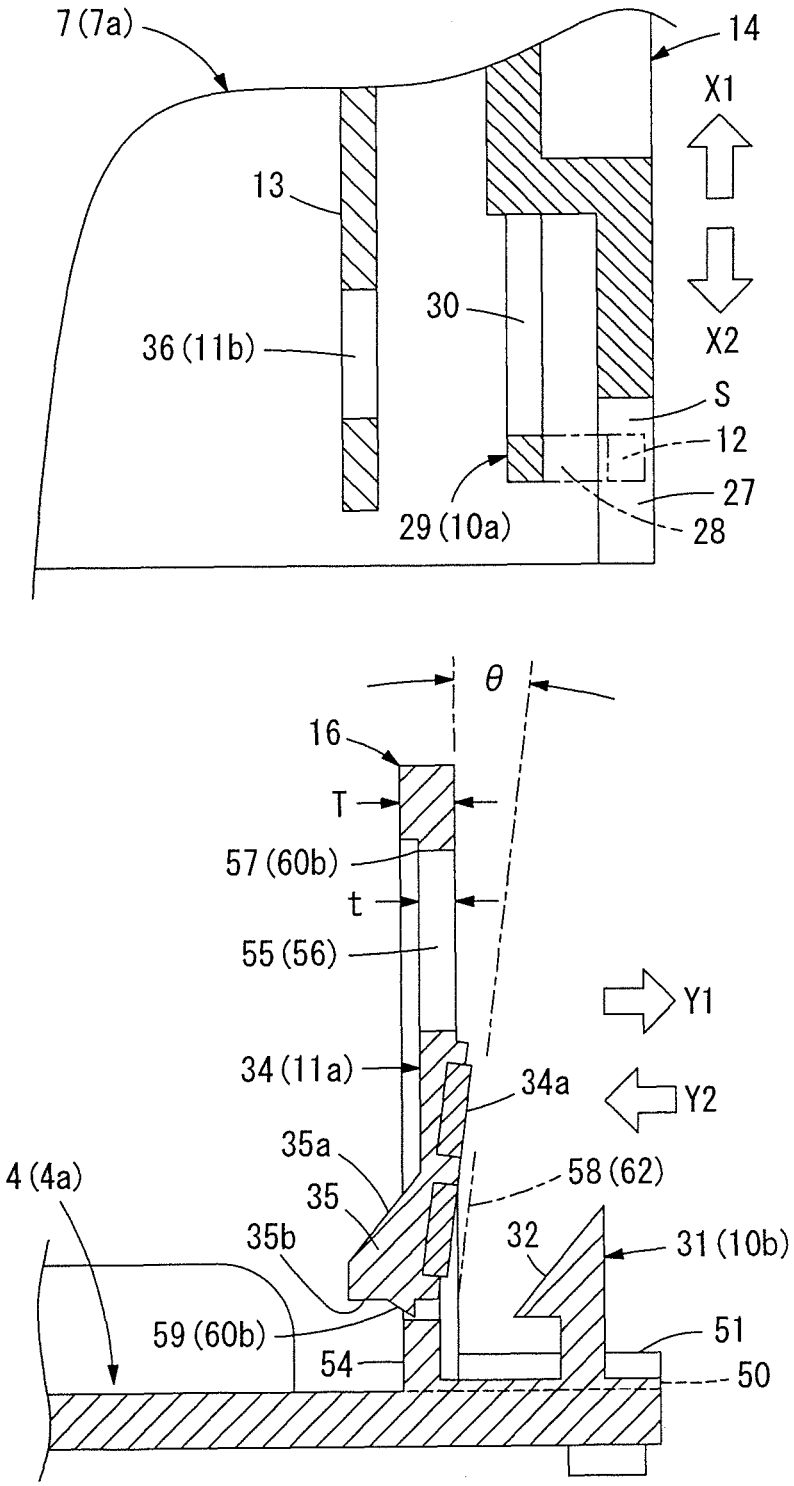
FIG. 8 is a vertical cross sectional view showing the first case component and the second case component separated from each other.

Permanent locking means 60 is arranged in the arms 34, at least in the arm 34 located at center among three arms. As shown in FIG. 8, the thickness (t) of the upper portion of the arm 34 is made thinner than the thickness (T) of the standing plate 16 in a manner that the inside surface, which is faced toward the Y2 direction, of the upper portion of the arm 34 is recessed. As a result, the arm 34 provides a thin portion 55. An aperture 56 is formed through the thin portion 55 so that a fragile hinge portion 57 is provided at the proximal end of the arm 34.

The outside surface, which is faced toward the Y1 direction, of the arm 34 is positioned at outside of the interrupting wall 54 and forms a guide surface 58 which inclines in the Y1 direction under an angle θ from the lower end to the upper portion. The hook 35 having the tapered guide 35*a* provides a projection 59 projecting from the engaging surface 35*b* at the bottom of hook 35.

The arm 34 stops moving at an original position as shown in FIG. 8 where the hook 35 projects from the standing plate 16 in the Y2 direction, and the projection 59 is apart upward from the interrupting wall 54. The arm 35 may move forward from this position in the Y1 direction upon receipt of an external force, and may move back in the Y2 direction to the original position upon cancellation of the external force. Such forward and backward movements of the arm 34 are carried out by the resiliency of the fragile hinge portion 57. The permanent locking means 60 is constituted by the projection 59 and/or the fragile hinge portion 57. When the arm 35 is pushed by an external force to move from the original stop position in the Y2 direction, the projection 59 moves to be engaged with the edge of the interrupting wall 54 and prevents the arm 35 from moving back in the Y1 direction to the original position. If the external force is strong, the fragile hinge portion 57 is damaged and looses its returning resiliency.

As shown in FIG. 1 (C), the unlocking device 3 provides a table 39 on which the display case 1 may be put slidably, and the unlock-structure section 40 standing up from the end of the table 39. The unlock-structure section 40 provides unlock projections 41 toward the table 39 and includes a permanent magnet 42 therein.

Locking Operation

Figure 9A:
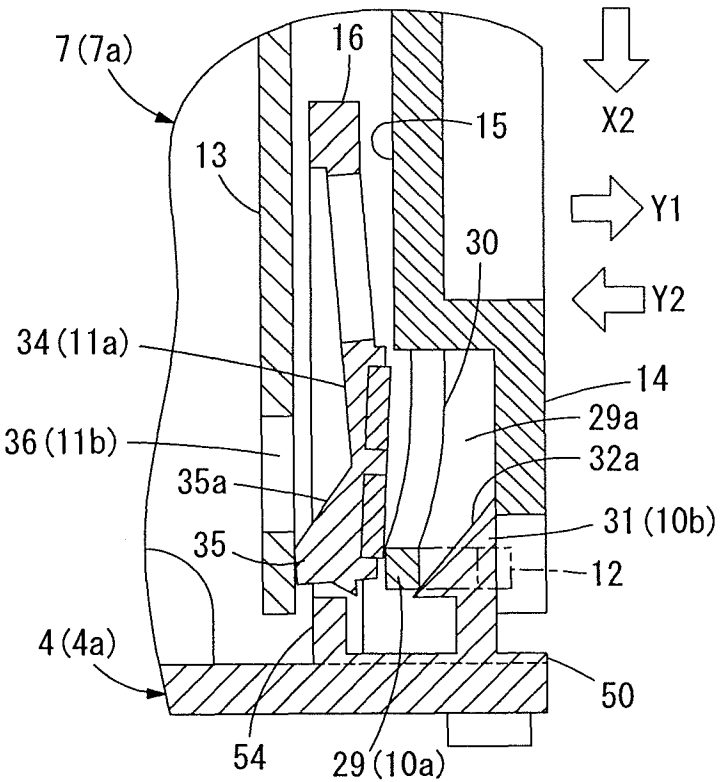
Figure 9B:
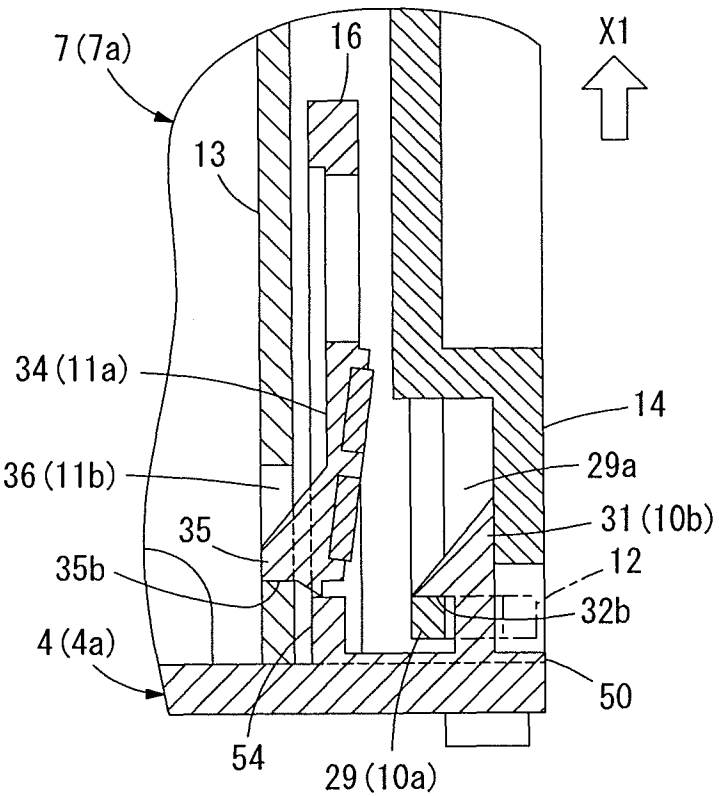

FIG. 9 (A) shows locking operation when the second case component 7 is moved in the X2 direction to be fitted in the first case component 4. FIG. 9 (B) shows the state where the locking is carried out by closing and fitting the case components 4 and 7 together.

As shown in FIG. 9 (A), when the case body 7*a* is moved in the X2 direction so as to cover the bottom member 4*a* (the case body 7*a* is rotated about the hinge means 8 toward the bottom member 4*a* to move the first latching member 10*a* in the downward direction X2 in the illustrated embodiment), the standing plate 16 is inserted in the space 15. Then, the first lock means 10 of projection-unlock-type and the second lock means 11 of magnet-unlock-type are locked simultaneously by one quick motion.

The locking operation of the first lock means 10 of projection-unlock-type is described as follows. During the hook-like member 31 of the first receiving member 10*b* enters in the gap 29*a* of the first latching member 10*a* as shown in FIG. 9 (A), the engaging portion 29 is pushed by the tapered guide 32*a* and is moved in the Y2 direction so that the hook 32 is allowed to be inserted in the gaps 29*a*. At the time when the hook 32 is completely inserted in the gap 29*a*, the engaging portion 29 returns to the original position and is engaged with the edge 32*b* of the hook 32 as shown in FIG. 9 (B). As a result, the lock of the first lock means 10 is carried out so that the case body 7*a* may not be moved in the X1 direction from the bottom member 4*a*. Since the bulged thick portion 50 positioned in the entrance 27 is close to the lower end of the operation portion 12, any space or gap, which might allow a tool such as screw driver to be inserted, is not formed between the operation portion 12 and the bottom member 4*a*.

The locking operation of the second lock means 11 of magnet-unlock-type is described as follows. During the standing plate 16 enters in the space 15 as shown in FIG. 9 (A), the arm 34 is moved in the Y1 direction in such manner that the tapered guide 35*a* of the hook 35 is pushed by the lower end of the inner plate 13. Then the standing plate 16 is allowed to be inserted in the space 15. At the time when the standing plate 16 is completely inserted in the space 15, the arm 34 returns to the original position and the engaging surface 35*b* of the hook 35 is engaged with the edge of the opening 36. As a result, the lock of the second lock means 11 is carried out so that the case body 7*a* may not be moved in the X1 direction from the bottom member 4*a*. Since the ribs 51 of the bottom member 4*a* and the grooves 52 of the outer plate 14 are fitted together, any space or gap, which might allow a tool such as screw driver to be inserted, is not formed between the lower end of the outer plate 14 and the bottom member 4*a*.

Unlocking Operation

Figure 10:
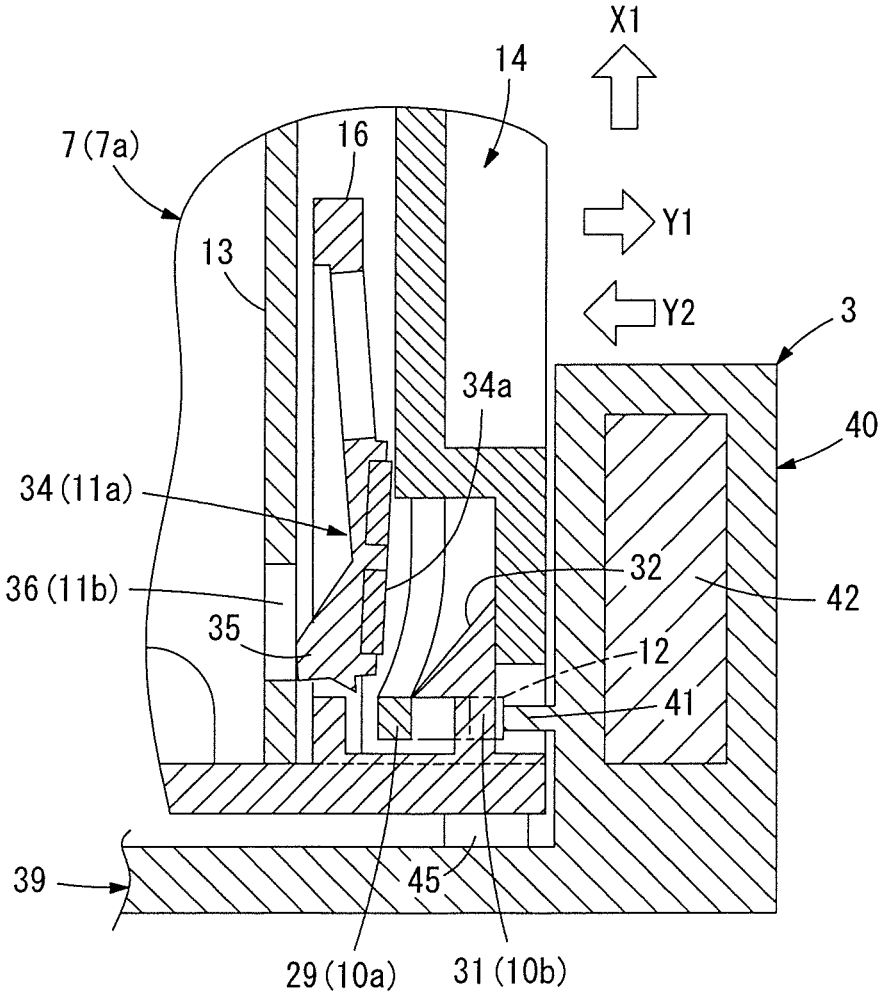
FIG. 10 is a cross sectional view showing the state that the first lock means and the second lock means are unlocked by a unlock-structure section of the unlocking device.

FIG. 10 shows unlocking operation of the locking mechanism by using the unlocking device 3. When the display case 1 is moved in the Y1 direction by sliding the bottom member on the table 39 of the unlocking device 3, the outer plate 14 approaches to the unlock-structure section 40. In order to make easy positioning of this approaching arrangement, marks 43 and 44 are provided on the display case 1 and the unlocking device 3 respectively as shown in FIG. 1 (the mark 43 is provided on the outer plate 14 and the mark 44 is provided on the upper surface of the unlock-structure section 40 in the illustrated example). In order to make the slide movement easy and to prevent the lower surface of the bottom member 4*a* from causing scratches, small projections 45 are formed on the lower surface of the bottom member 4*a* (at each corner of the bottom member for example).

When the display case 1 is moved in a sliding manner on the table 39 in the Y1 direction, the operation portions 12 are directed to the unlock projections 41, and the magnetic pieces 34*a* are directed to the magnet 42. When the slide movement is carried out until the outer plate 14 approaches closely to the unlock-structure section 40, the operation portion 12 is pushed in the Y2 direction by the unlock projection 41. Then, the engaging portion 29 becomes disengaged from the hook 32 so that the first lock means 10 of projection-unlock-type is unlocked. At the same time, the arm 34 moves in the Y1 direction with the magnetic piece 34*a* drawn by the magnet 42. Then, the hook 35 becomes disengaged from the opening 36 so that the second lock means 11 of magnet-unlock-type is unlocked.

The unlock projections 41, which are pushing the operation portions 12, are positioned above the edge of the bottom member 4*a*, and the case body 7*a* may be pulled up in the X1 direction to open the upper area of the bottom member 4*a* where the product M is laid. Accordingly, the product M on the bottom member 4*a* can be immediately taken in hands.

Operation of Permanent Locking Means

Figure 11:
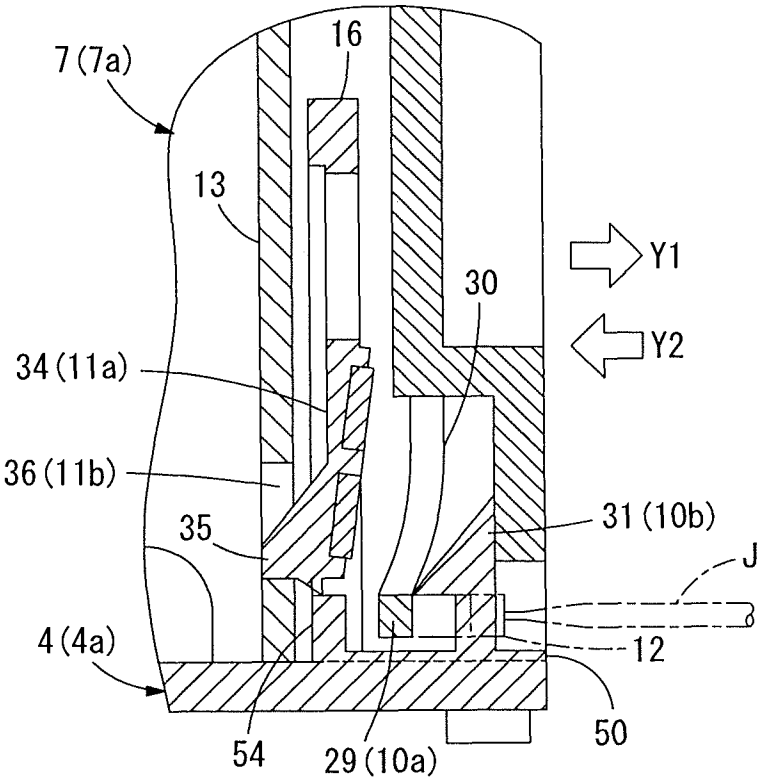
FIG. 11 shows an operation of permanent locking means.
Figure 11:
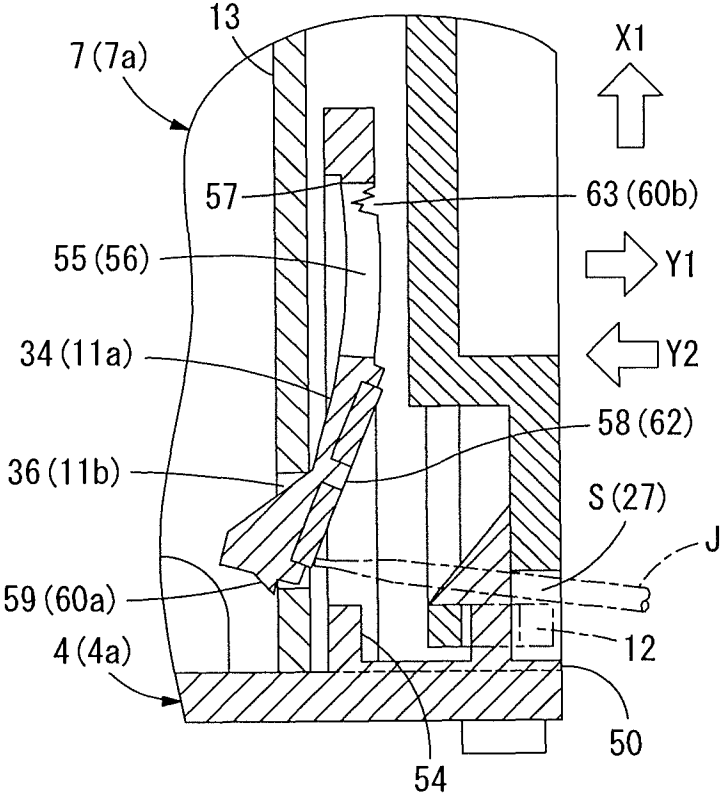

FIG. 11 shows an operation when a thief tries to unlock the locking mechanism.

If the operation portions 12, 12 are pushed inward, by a thief, with a tool J such as a screw driver inserted in the entrances 27, 27, to move the first latching member 10*a* backward from the first receiving member 10*b*, the first lock means 10 of projection-unlock-type may possibly be unlocked. Even in such event, however, the second case component 7 cannot be moved in the X1 direction, since the second lock means 11 of magnet-unlock-type still keeps the locking state.

Then, the thief, who has failed in unlocking as mentioned above, might try to unlock the second lock means 11 of magnet-unlock-type by inserting the tool J in the gap S of the entrance 27. If the tool J is deeply inserted as shown in FIG. 11 (B), the arm 34 of the second latching member 11*a* may be pushed in the Y2 direction. Then, the projection 59 moves out the opening 36 and becomes engaged with the outer edge of the opening 36. As a result, the second case component 7 cannot be moved in the X1 direction because the hook 35 is inserted through the opening 36. Even when the thief pulls the tool J out the gap S, the projection 59 is engaged with the edge of the opening 36 and prevents the arm 35 from moving back in the Y1 direction. Thus, first permanent locking means 60*a* is constituted. Once the first permanent locking means 60*a* carries out its function, the second lock means 11 can no loner be unlocked even if a magnet is approached to the lock-structure section 9.

As mentioned above, the interrupting wall 54 is positioned at the lower end of the arm 34. The arm 34 forms the guide surface 58 inclining in the Y1 direction under an angle θ from the lower end to the upper portion. The lower end of the guide surface 58 is positioned in the thickness T of the standing plate 16 (inside of the space 53). Accordingly, it is almost impossible for the thief to accidentally catch the arm 34 to be pulled in the Y1 direction, by inserting the tool J through the gaps S and moving the tool J for exploring inside around the interrupting wall 54. Since the guide surface 58 is positioned within the thickness T of the standing plate 16, the moving tool J may be guided toward the lower end of the arm 34 by the guide surface 58. Then, the tool J may push the arm 34 easily in the Y2 direction and may cause the locking operation of the first permanent locking means 60*a* as mentioned above. Thus, inducing means 62 for causing the permanent lock is constituted by the guide surface 58.

If the arm 34 is pushed strongly in the Y2 direction by inserting the tool J deeply as mentioned above, the fragile hinge portion 57 may break to form a breakage 63 as shown in FIG. 11(B). In this state, the hook 35 of the arm 34 is engaged with the edge of the opening 36 so that the second case component 7 cannot be moved in the X1 direction. Since the returning resiliency of the arm 34 is lost due to the breakage 63, the arm 34 cannot move back in the Y1 direction even if the tool J is pulled out the gap S. Thus, second permanent locking means 60*b* is constituted. Once the second permanent locking means 60*b* carries out its function, the second lock means 11 can no loner be unlocked even if a magnet is approached to the lock-structure section 9.

The illustrated embodiment shows the first permanent locking means 60*a* comprising the projection 59 of the hook 35, and the second permanent locking means 60*b* comprising the breakage 63 of the fragile hinge portion 57. However, the permanent locking means 60 of the present invention may comprise only one of the first and second permanent locking means 60*a* and 60*b*. As shown in the illustrated example, it is preferred to form the projection 59 of the first permanent locking means 60*a* in a wedge shape in cross section so that it may be easy to advance into the opening 36 and may be hard to be moved back, but such configuration is not limited in the present invention. The projection 59 may be provided in the lower edge of the opening 36 instead of providing in the hook 35. In summary, the permanent locking means 60 may be constituted alternatively as far as it has a function for permanent locking in such manner that the second latching member 11*a*, when it is pushed in the Y2 direction, becomes engaged with the second receiving member 11*b* so that the second latching member 11*a* cannot be moved back in the Y1 direction.

As mentioned above, once after the permanent locking means 60 functions in response to an illegal action by a thief, the first case component 4 and the second case component 7 cannot be separated with each other. Then, if a thief tries to take the display case 1 out the store, the security tag 17 therein will be detected at the exit. Once after the permanent locking means 60 functions, the product M cannot be taken out the display case 1, unless the display case 1 is destroyed.

Locking Mechanism Provided with Self-Lock Means

The present invention provides the locking mechanism 2 which provides the second lock means 11 of magnet-unlock-type with self-lock means 63. The self-lock means 63 comprises a lock member 64 which is movable between a locking position and a unlocking position. The lock member 64 is usually held to keep the locking position so that the first latching member 11*a* cannot move in the Y1 direction. When the lock member 64 is moved to the unlocking position, the first latching member 11*a* is allowed to move in the Y1 direction. Accordingly, the second latching member 11*a* is kept latched on the second receiving member 11*b* without possibility of unlatching, even when a strong shock, such as dropping the display case 1 on a floor, is given. Thereby, the locking state of the second lock means 11 is guaranteed.

First Embodiment of the Self-Lock Means

Figure 12:
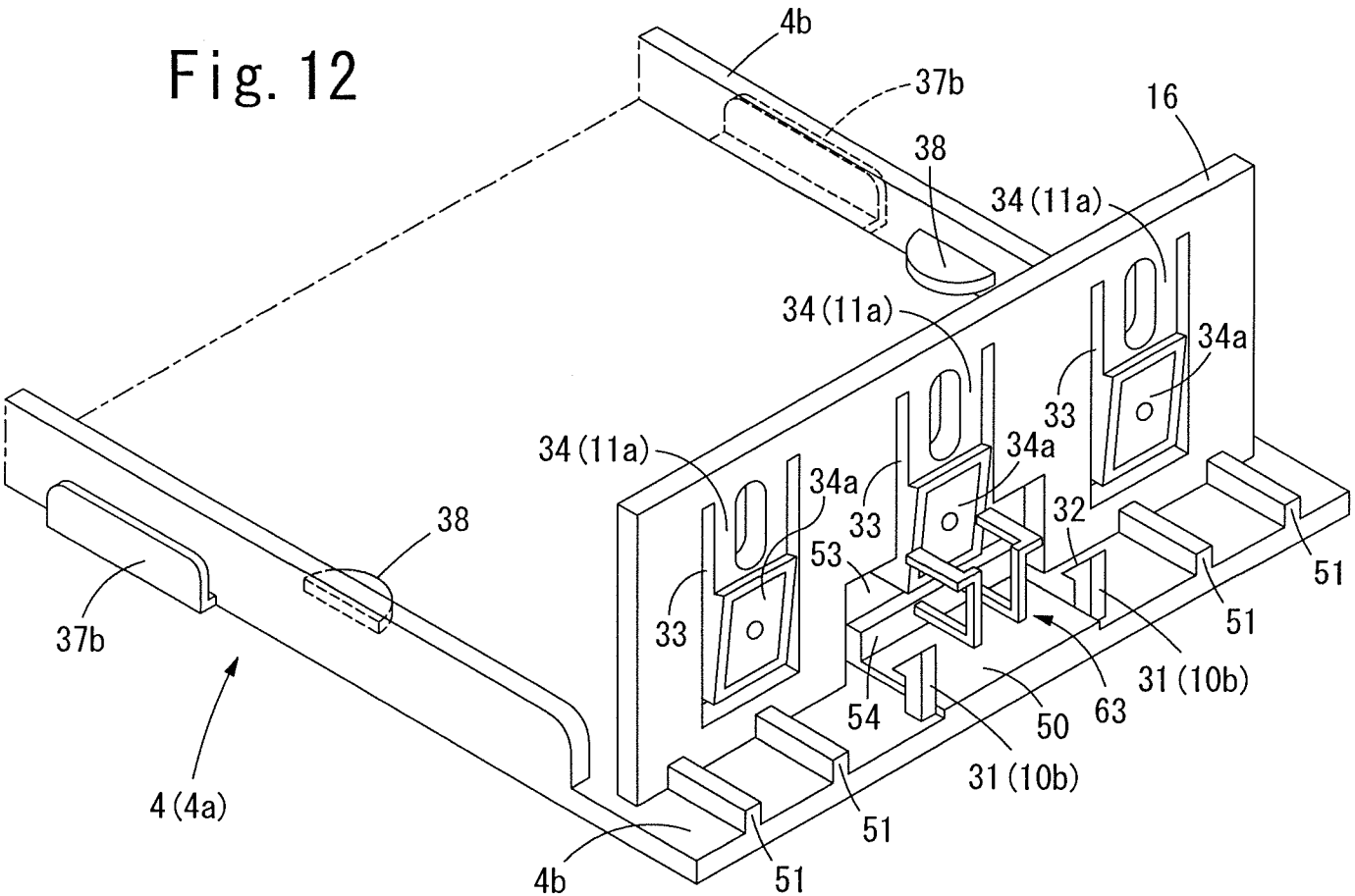
FIG. 12 is a perspective view showing a first embodiment of self-lock means in which a front side of lock members provided in the standing plate of the first case component is shown.
Figure 13:
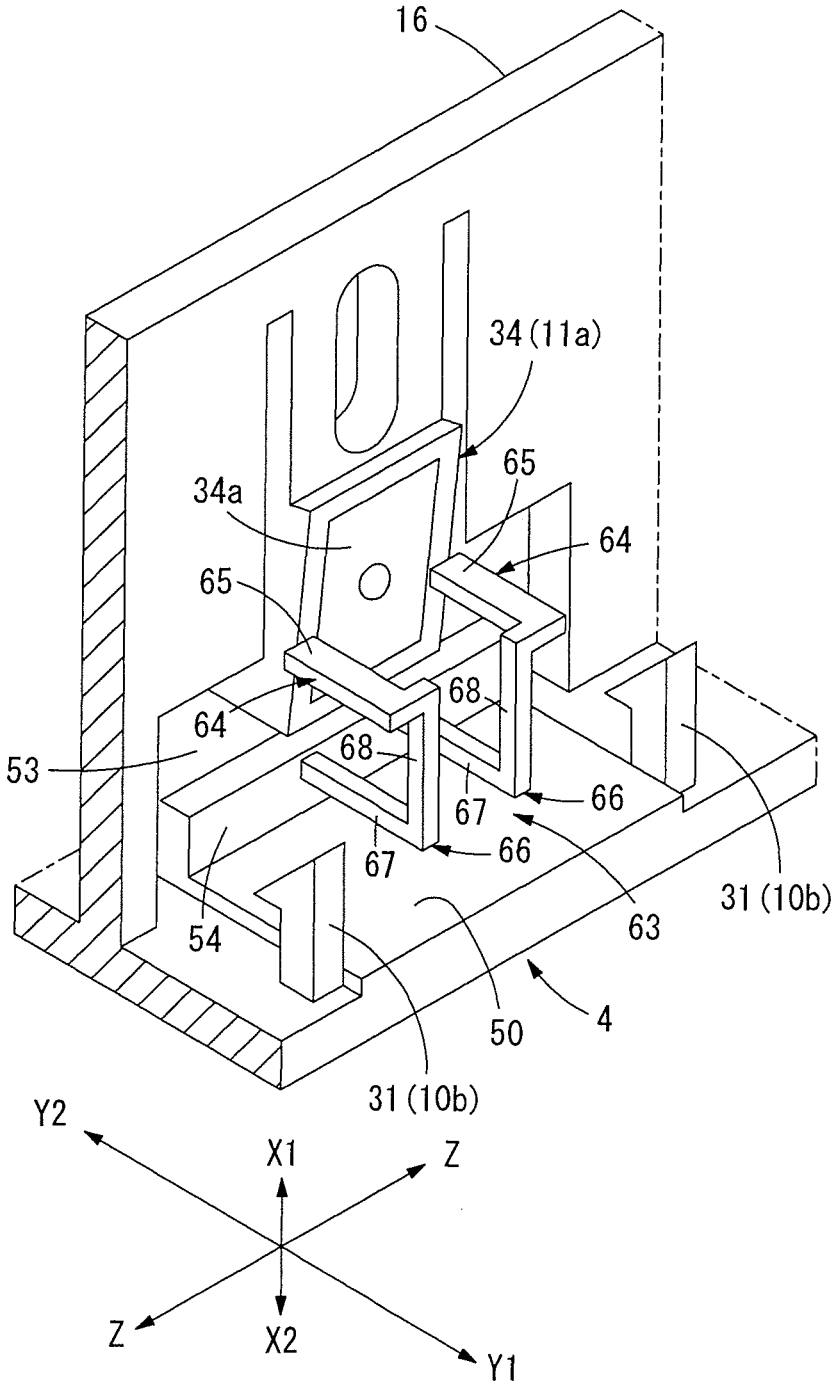
FIG. 13 is an enlarged perspective view showing the lock members of the first embodiment of the self-lock means.

FIG. 12 to FIG. 17 show a first embodiment of the self-lock means. As shown in FIG. 12 and FIG. 13, the self-lock means 63 comprises a pair of lock members 64, 64 provided at both sides of the arm 34 which constitutes at least one latching member 11*a* selected among three latching members as shown (the central latching member 11*a* is selected in the illustrated example). The lock members 64, 64 are symmetrically arranged and are provided respectively with lock portions 65, 65 and resilient support means 66, 66 which support the lock portions 65, 65. The lock portions 65, 65 are faced to both sides of the arm 34 in a direction opposite to the Y1 direction so that the arm 34 is prevented from moving in the Y1 direction. Each resilient support means 66 comprises a resilient arm 67 extended from the interrupting wall 54 in the Y1 direction, and an operating arm 68 extended upward from the resilient arm 67. The lock portion 65 extends from the operating arm 68 in the Y2 direction. The lock member 64 is formed by a flexible plastic integrally with the interrupting wall 54.

Figure 14A:
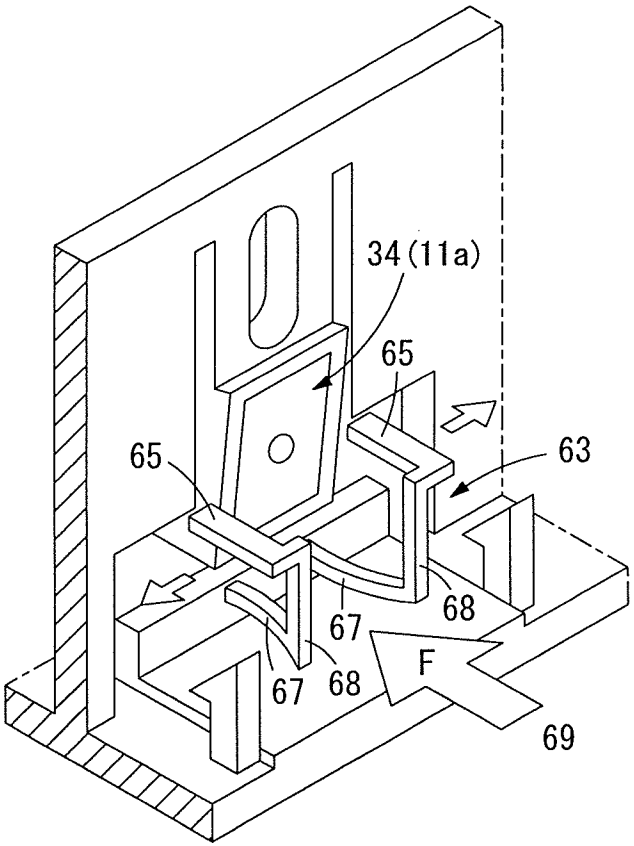
FIG. 14 shows an operation of the first embodiment of the self-lock means.

The lock portions 65, 65 are movable between a locking position and a unlocking position by deforming the resilient support means 66, 66 in a Z direction (in a direction along the width of the arm 34) which intersects both the Y direction and the X direction. The lock portions 65, 65 are usually held to keep the locking position by the resilient support means 66, 66. In the locking position, the lock portions 65, 65 oppose to both front sides of the arm 34 and prevent the arm 34 from moving in the Y1 direction as shown in FIG. 13. When the lock portions 65, 65 are moved to the unlocking position where the lock portions 65, 65 get out the front of the arm 34 as shown in FIG. 14(A), the arm 34 becomes movable in the Y1 direction.

Figure 14B:
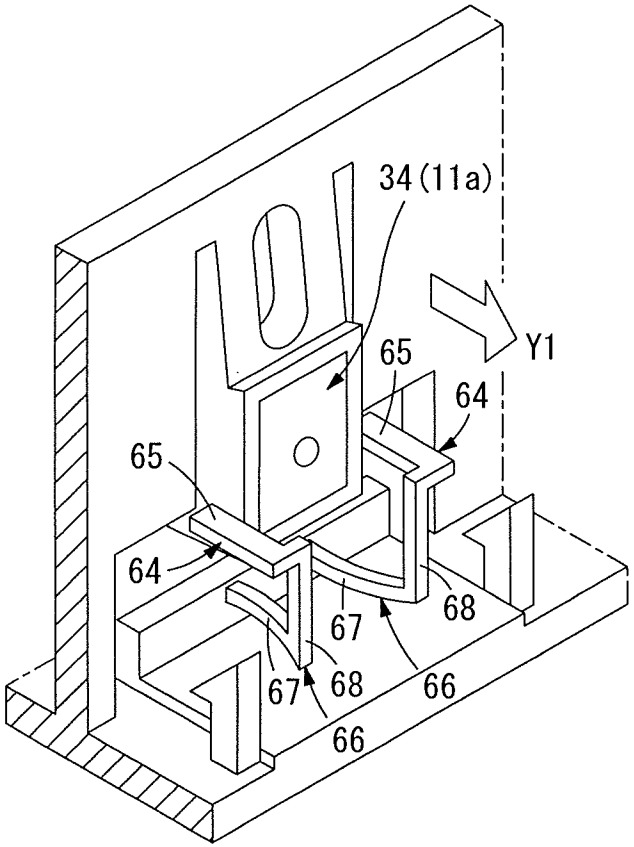

When the first and second case components 4 and 7 are fitted together, and the arm 34 (the second latching member 11*a*) is engaged with the edge of the opening 36 (the second receiving member 11*b*), the arm 34 is prevented from moving in the Y1 direction by the self-lock means 63 which holds the lock portions 65, 65 in the locking position. If the resilient support protons 66, 66 are pushed outward to be apart from each other by inserting actuating means 69 therebetween as shown by an arrow F in FIG. 14(A), the lock portions 65, 65 move to the unlocking position. In this state, the second latching member 11*a* may move in the Y1 direction to be disengaged with the second receiving member 11*b* as shown in FIG. 14(B), when a magnet is put close to the second latching member 11*a*.

Figure 15A:
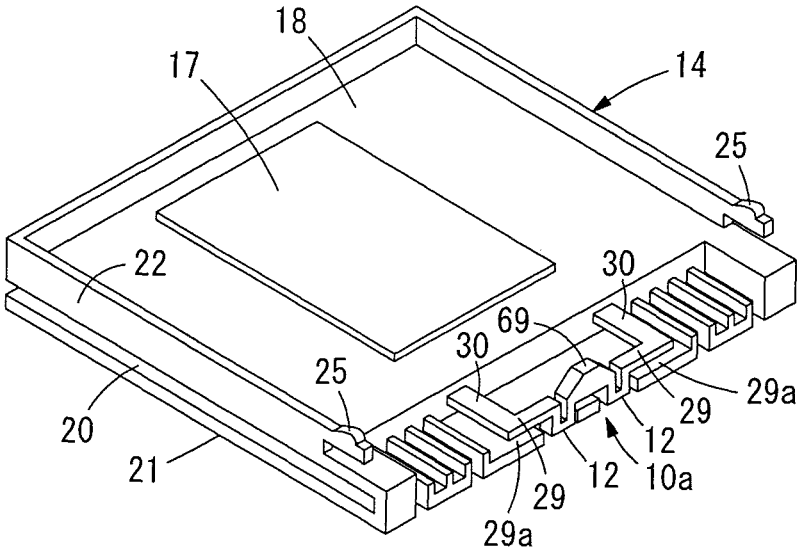
FIG. 15 shows the first embodiment of the self-lock means.
Figure 15B:
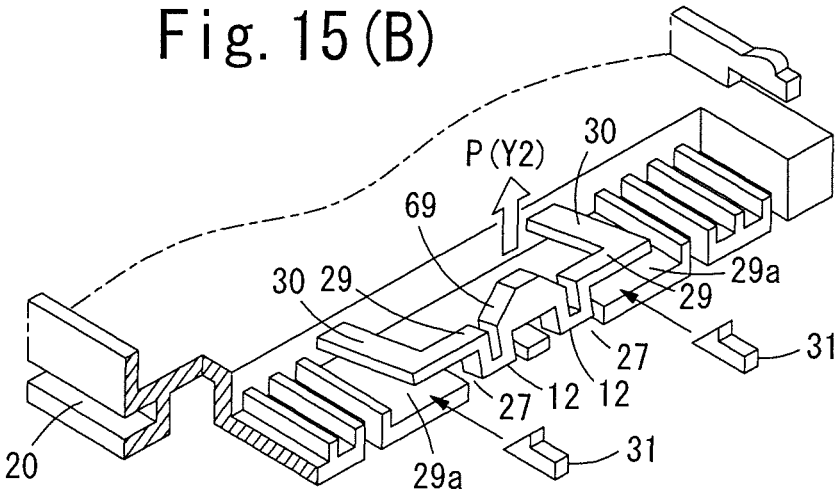

The actuating means, which is indicated by the arrow F, comprises an unlock actuator 69 provided in the first latching member 10*a* of the first lock means 10 of the projection-unlock-type as shown in FIG. 15. In the illustrated example, the actuator 69 is connected to the operation portions 12, 12 and extended to protrude in the Y2 direction. It is preferred to form tapered guide surfaces on both sides of the actuator 69 as illustrated.

Locking Operation of the First Embodiment of the Self-Lock Means

Figure 16A:
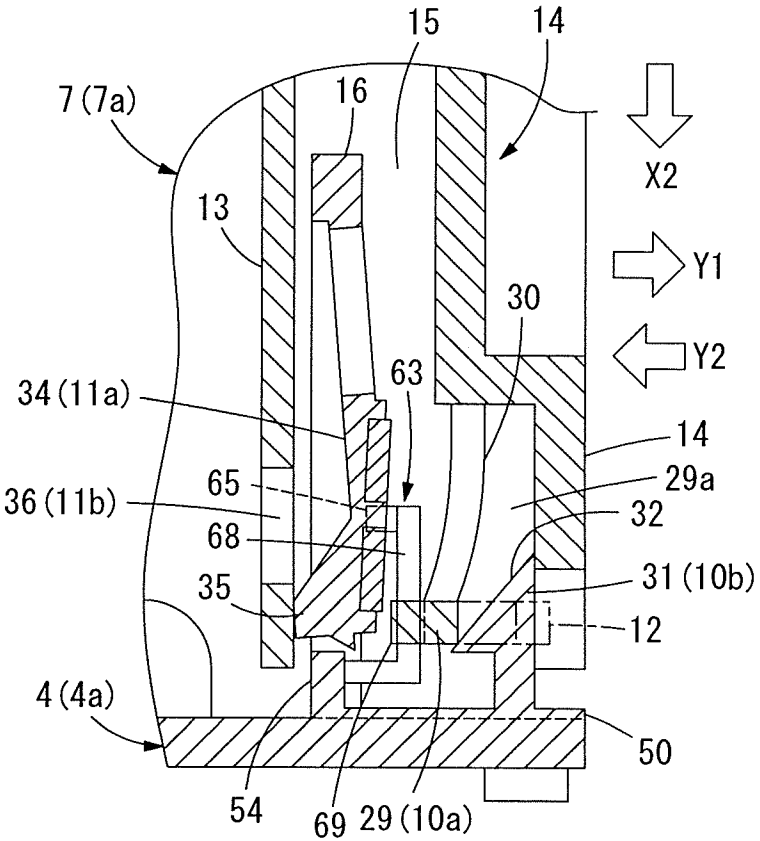

As shown in FIG. 16(A), when the case body 7*a* is moved in the X2 direction so as to cover the bottom member 4*a*, the standing plate 16 is inserted in the space 15. Then, the first lock means 10 of projection-unlock-type and the second lock means 11 of magnet-unlock-type are locked simultaneously by one quick motion as mentioned above.

When the first receiving member 10*b* (the hook 32) enters in the gap 29*a* of the first latching member 10*a*, the engaging portion 29 is pushed by the tapered guide 32*a* of the hook 32 and is moved in the Y2 direction. At the same time, the actuator 69 moves in the Y2 direction and pushes the resilient support means 66, 66 outwardly to be moved to the unlocking position.

Figure 16B:
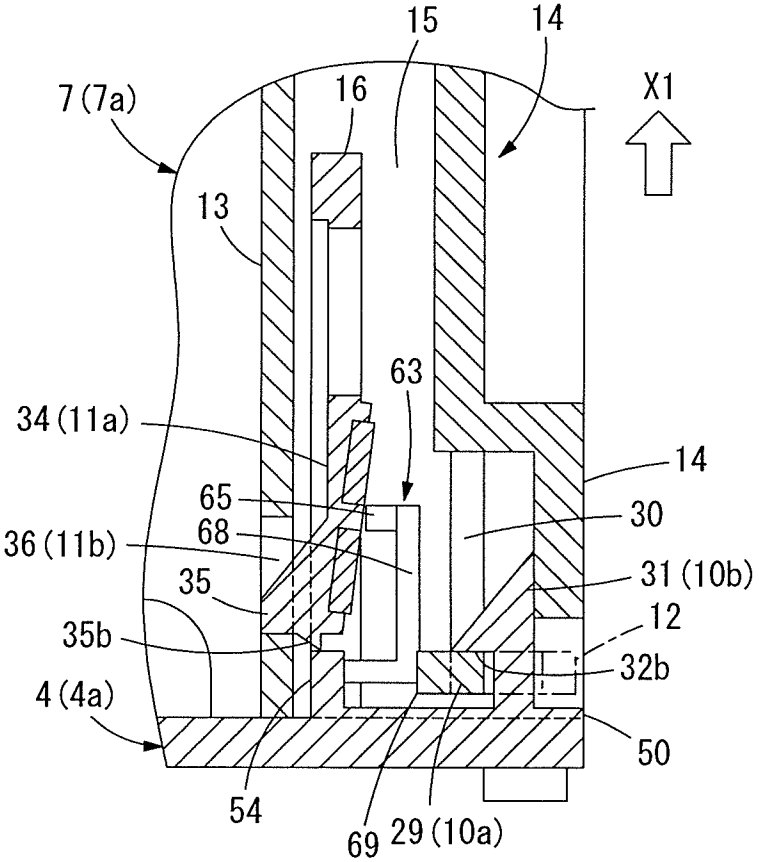
Figure 17:
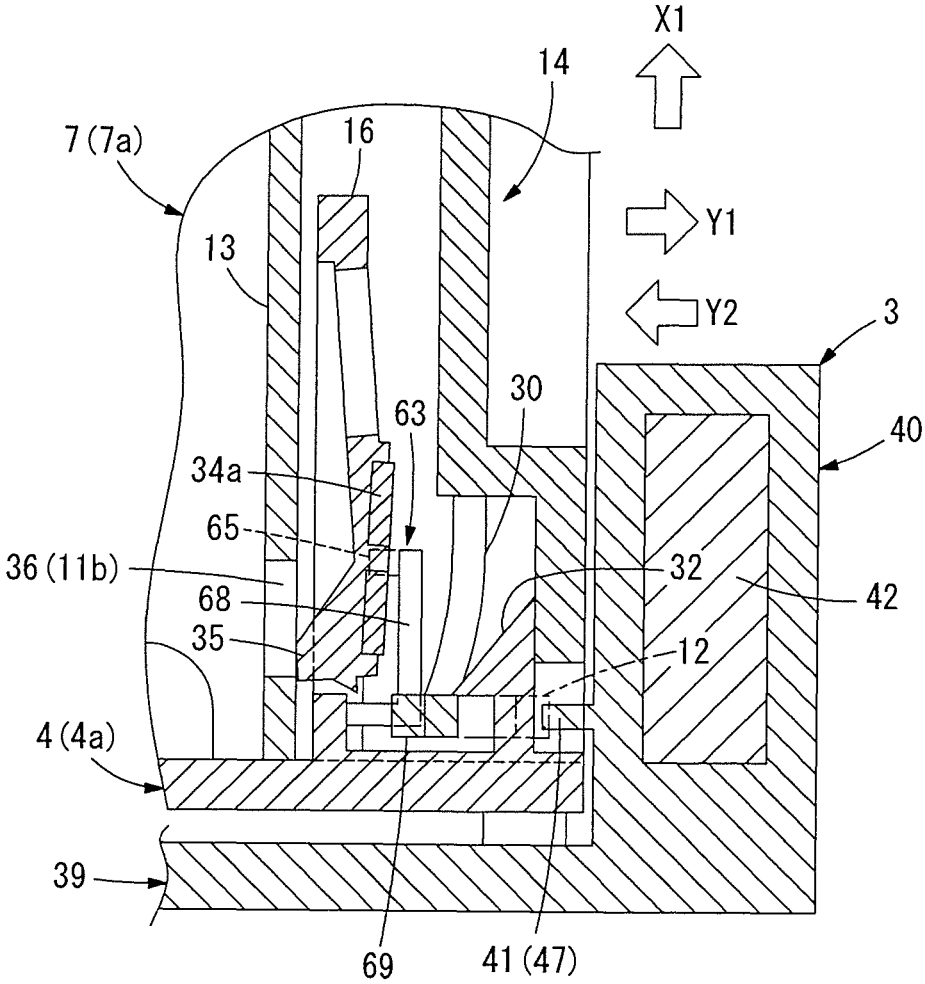
FIG. 17 is a cross sectional view of the first embodiment of the self-lock means showing the state that the self-lock means, the first lock means and the second lock means are unlocked simultaneously by the unlock-structure section of the unlocking device.

Since the arm 34 is allowed to move in the Y1 direction, the second lock means 11 is locked in such manner that the arm 34 is pushed by the inner plate 13 and moves in the Y1 direction, and subsequently moves back in the Y2 direction and engages the hook 35 with the edge of the opening 36 (see FIG. 16(B)).

When the hook 32 is completely inserted in the gap 29*a*, the first lock means 10 is locked in such manner that the engaging portion 29 returns to the original position and is engaged with the edge 32*b* of the hook 32.

The unlock actuator 69 returns to the original position together with the return movement of the engaging portion 29. Then, the lock portions 65, 65 moves to the locking position and prevent the arm 34 from moving in the Y1 direction.

Unlocking Operation of the First Embodiment of the Self-Lock Means

The locking mechanism may be unlocked by the unlocking device 3. When the display case 1 is moved in the Y1 direction by sliding the bottom member 4*a* on the table 39 of the unlocking device 3, the unlock projection 41 pushes the operation portion 12 in the Y2 direction so that the engaging portion 29 becomes disengaged from the hook 32. Then, the first lock means 10 of projection-unlock-type is unlocked. The magnet 42 draws the magnet piece 34*a* so that the arm 34 moves in the Y1 direction to disengage the hook 35 from the opening 36. Then, the second lock means 11 of magnet-unlock-type is unlocked.

The unlock projections 41 constitute unlocking means 47 to push the operation portion 12 together with the actuator 69 in the Y2 direction. When the actuator 69 is entered in the space between the operating arms 68, 68, the lock portions 65, 65 of the self-lock means 63 are moved to the unlocking position for allowing the arm 34 to move in the Y1 direction. The magnet 42 draws the arm 34 to be disengaged from the opening 36 so that the second lock means 11 is unlocked.

Second Embodiment of the Self-Lock Means

Figure 18A:
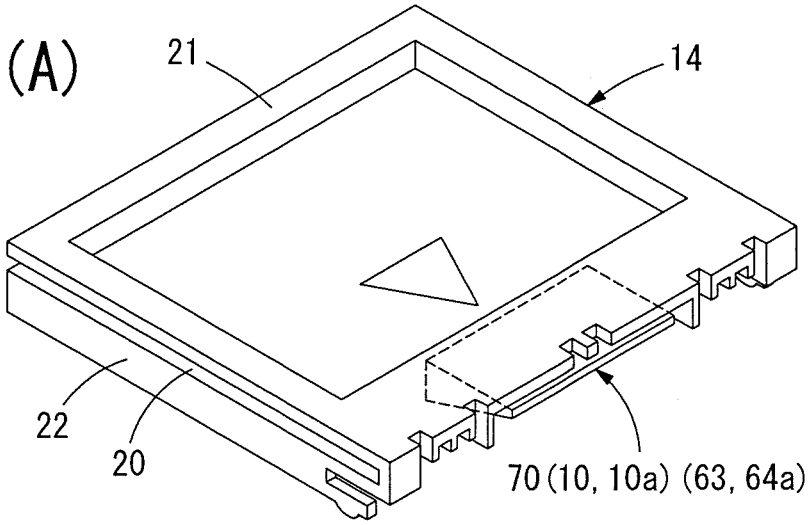
FIG. 18 shows a second embodiment of the self-lock means.
Figure 18B:
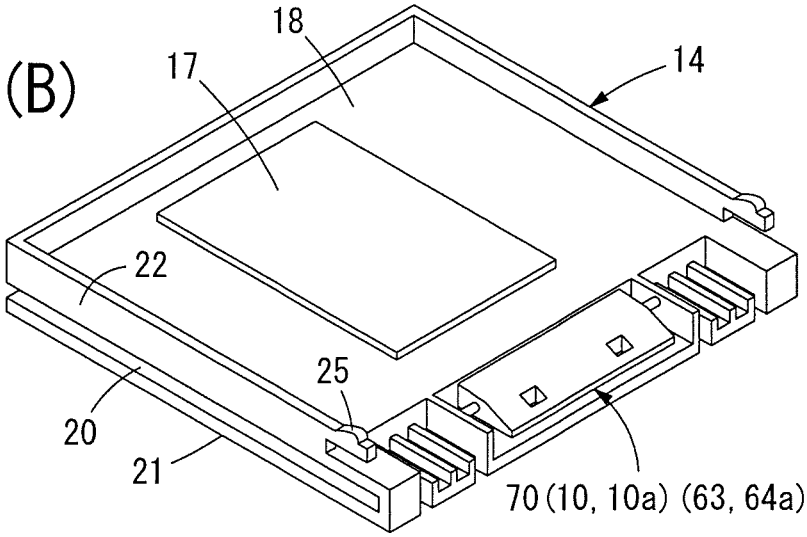
Figure 19:
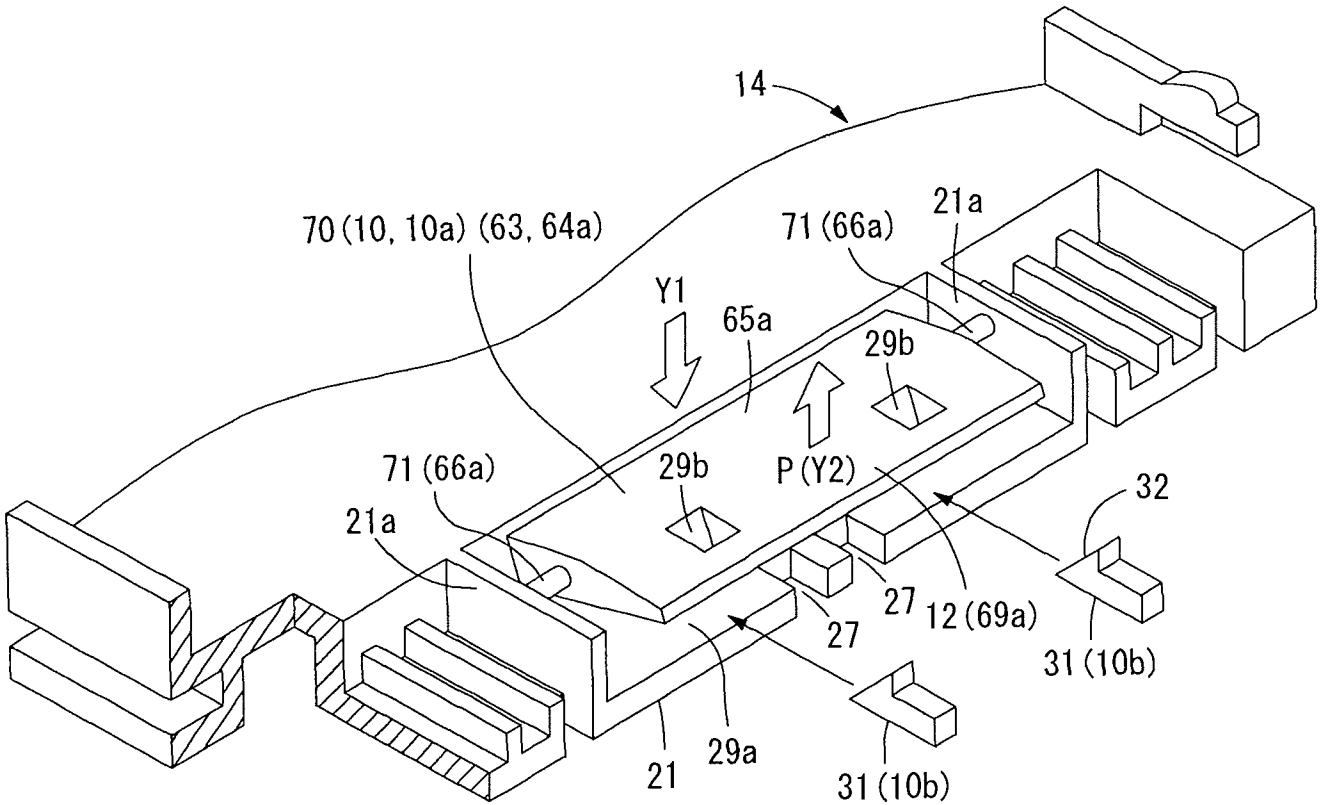
FIG. 19 is an enlarged perspective view showing a lock member of the second embodiment of the self-lock means.

FIG. 18 to FIG. 20 show a second embodiment of the self-lock means. In the second embodiment of the self-lock means 63, modifications are made in the above-mentioned first latching member 10*a* of the first lock means 10. Since the other features are same to those of the embodiment mentioned above, the same features are indicated by the same reference numerals in the drawings, and duplicate description will be omitted.

As shown in FIG. 18 and FIG. 19, the first latching member 10*a* of the first lock means 10 of projection-unlock-type, which is provided in the outer plate 14 of the case body 7*a*, comprises a rotary 70 provided with engaging portions 29*b* formed by apertures or recessions. The rotary 70 provides resilient axes 71 which connect the both ends of the rotary 70 to rib-like walls 21*a*, 21*a* extended from the plate wall 21. The rotary 70 and the axes 71 are formed integrally with the walls 21*a*, 21*a* by a flexible plastic so that the axes 71 comprise torsion axes (resiliently rotatable axes) which may be rotated resiliently. Then, the rotary 70 constitutes not only the first latching member 10*a* of the first lock means 10 but also the lock member 64*a* of the self-lock means 63.

In order to constitute the first latching member 10*a* of the first lock means 10, the rotary 70 provides an operation portion 12 adjacent to the entrances 27 of the plate wall 21. A gap 29*a* is formed between the operation portion 12 and the plate wall 21 of the outer plate 14. When the hook-like member 31, which constitutes the first receiving member 10, is inserted in the gap 29*a* as shown in FIG. 19, a pushing force P is given to the operation portion 12 in the Y2 direction. The resilient axes 71 twist to enlarge the gap 29*a* so that the hook 32 may enter in the engaging portion 29*b*. Subsequently, the rotary 70 returns to the original position by restoration of the resilient axes 71, while the engaging portion 29*b* is engaged with the hook 32.

In order to constitute the self-lock means 63, the rotary 70 provides a lock portion 65*a* in the side opposite to the operation portion 12. The lock portion 65*a* may move between a locking position and a unlocking position in the Y direction. When the resilient axes 71 are not twisted, the lock portion 65*a* stays at the locking position. When the resilient axes 71 are twisted upon receipt of the pushing force P, the lock portion 65*a* moves to the unlocking position. Thus, the resilient axes 71 constitute resilient support means 66*a* to resiliently hold the lock portion 65*a* to the locking position. The operation portion 12, which may receive the pushing force P by the hook-like member 31, constitutes a unlock actuator 69*a*.

Locking Operation of the Second Embodiment of the Self-Lock Means

As shown in FIG. 20, when the case body 7*a* is moved in the X2 direction so as to cover the bottom member 4*a*, the standing plate 16 is inserted in the space 15. Then, the first lock means 10 of projection-unlock-type and the second lock means 11 of magnet-unlock-type are locked simultaneously by one quick motion as mentioned above.

With respect to the first lock means 10, when the first receiving member 10*b* (the hook 32) enters in the gap 29*a* of the first latching member 10*a* as shown in FIG. 20 (A), the operation portion 12 is pushed by the tapered guide of the hook 32 and is moved in the Y2 direction. Then, the resilient axes 71 are transformed to be twisted. When the hook 32 is completely inserted in the gap 29*a* as shown in FIG. 20 (B), the operation portion 12 returns to the original position and the engaging portion 29*b* is engaged with the hook 32. Thus the first lock means 10 is locked.

Figure 20A:
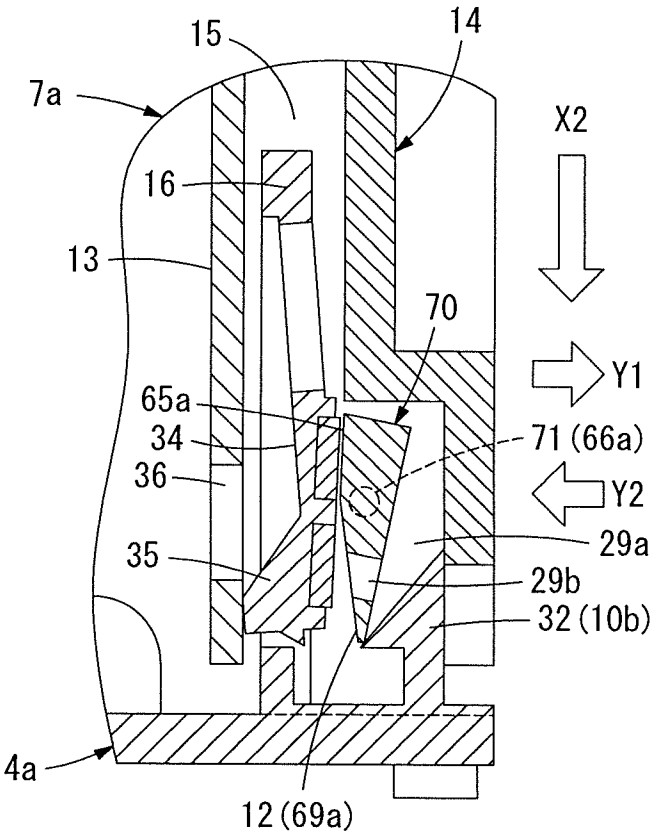
Figure 20B:
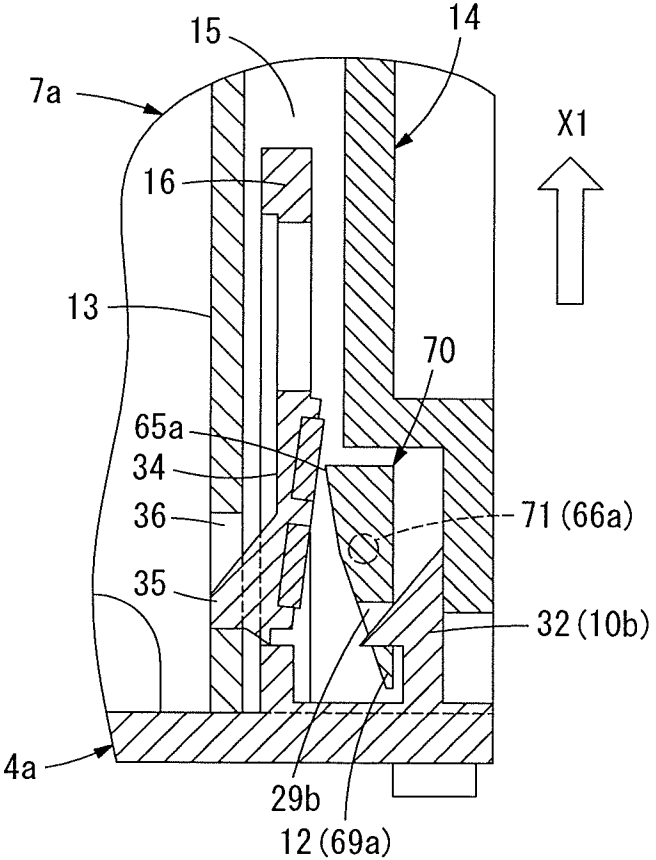

With respect to the second lock means 11, when the unlock actuator 69*a* (the operation portion 12) is moved along the tapered guide surface of the hook 32 as shown in FIG. 20(A), the lock portion 65*a* moves back from the arm 34 and moves to the unlocking position by twisting the resilient support means 66*a* (the resilient axes 71). Since the arm 34 is allowed to move in the Y1 direction, the arm 34 is pushed by the inner plate 13 and moves in the Y1 direction, and subsequently moves back in the Y2 direction to engage the hook 35 with the edge of the opening 36 as shown in FIG. 20(B). Thus the second lock means 11 is locked.

The rotary 70 returns to the original position by restoration of the resilient axes 71. Then, the lock portions 65*a* moves to the locking position and prevents the arm 34 from moving in the Y1 direction.

Unlocking Operation of the Second Embodiment of the Self-Lock Means

Figure 21:
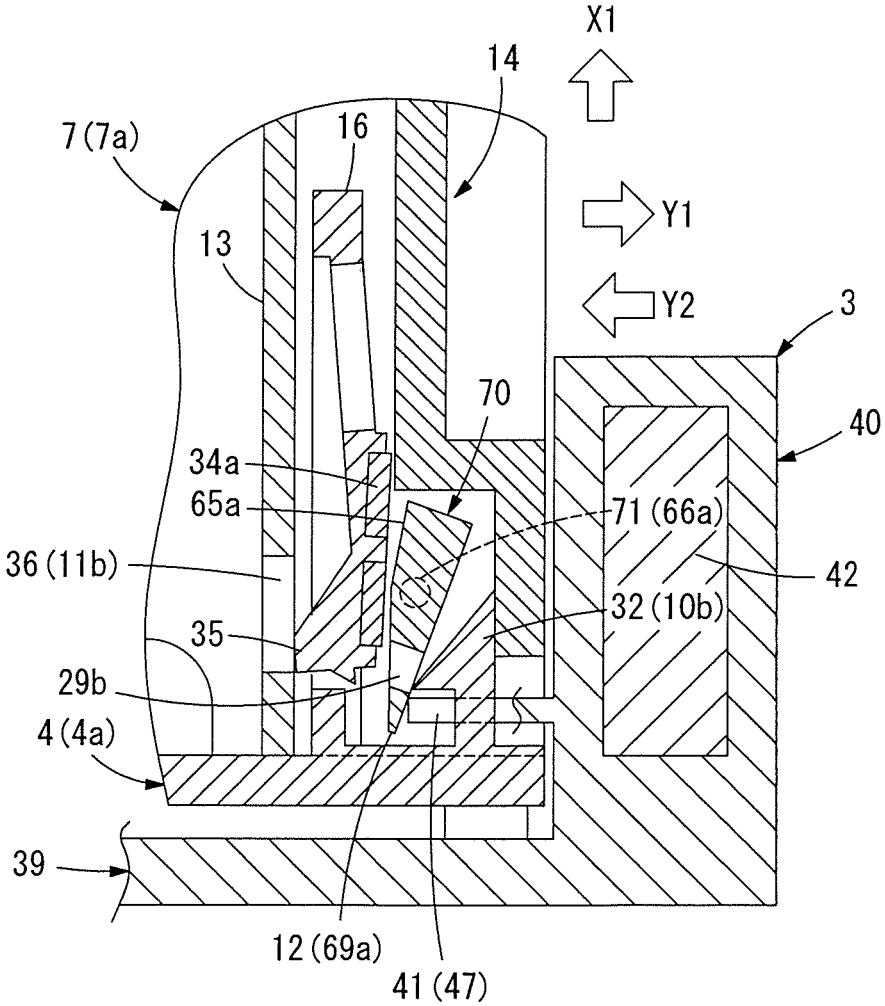
FIG. 21 is a cross sectional view of the second embodiment of the self-lock means showing the state that the self-lock means, the first lock means and the second lock means are unlocked simultaneously by the unlock-structure section of the unlocking device.

The locking mechanism may be unlocked by the unlocking device 3. When the display case 1 is moved in the Y1 direction by sliding the bottom member 4*a* on the table 39 of the unlocking device 3 as shown in FIG. 21, the unlock projection 41 pushes the operation portion 12 in the Y2 direction so that the engaging portion 29 becomes disengaged from the hook 32. Then, the first lock means 10 of projection-unlock-type is unlocked. The operation portion 12 constitutes the unlock actuator 69*a*, and the unlock projection 41 constitutes the unlocking means 47. When the lock portion 65*a* moves back from the arm 34 toward the unlocking position, the arm 34 is allowed to move in the Y1 direction. The magnet 42 draws the magnet piece 34*a* so that the arm 34 moves in the Y1 direction to disengage the hook 35 from the opening 36. Then, the second lock means 11 of magnet-unlock-type is unlocked.

Third Embodiment of the Self-Lock Means

Figure 22:
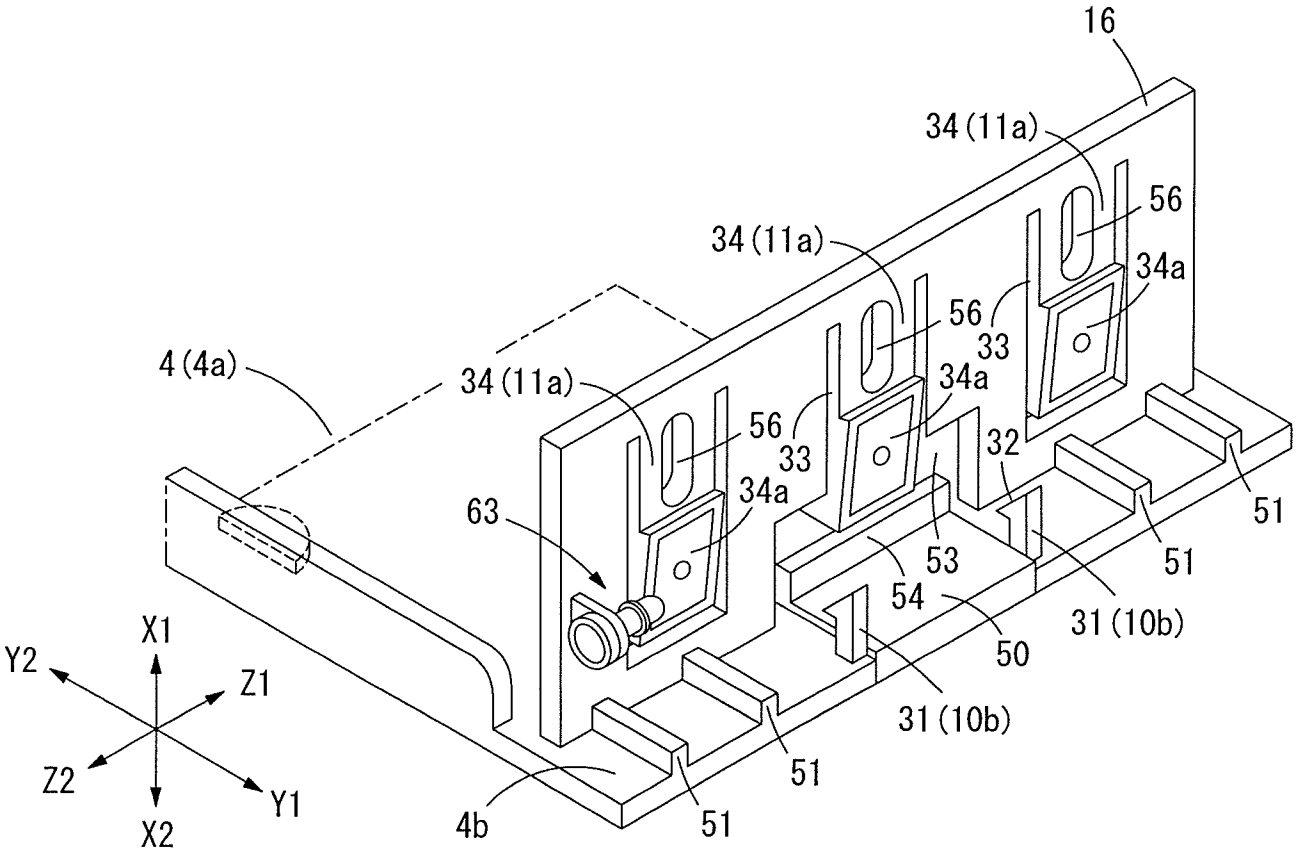
FIG. 22 is a perspective view showing a third embodiment of the self-lock means in which a front side of the standing plate of the first case component is shown.
Figure 23:
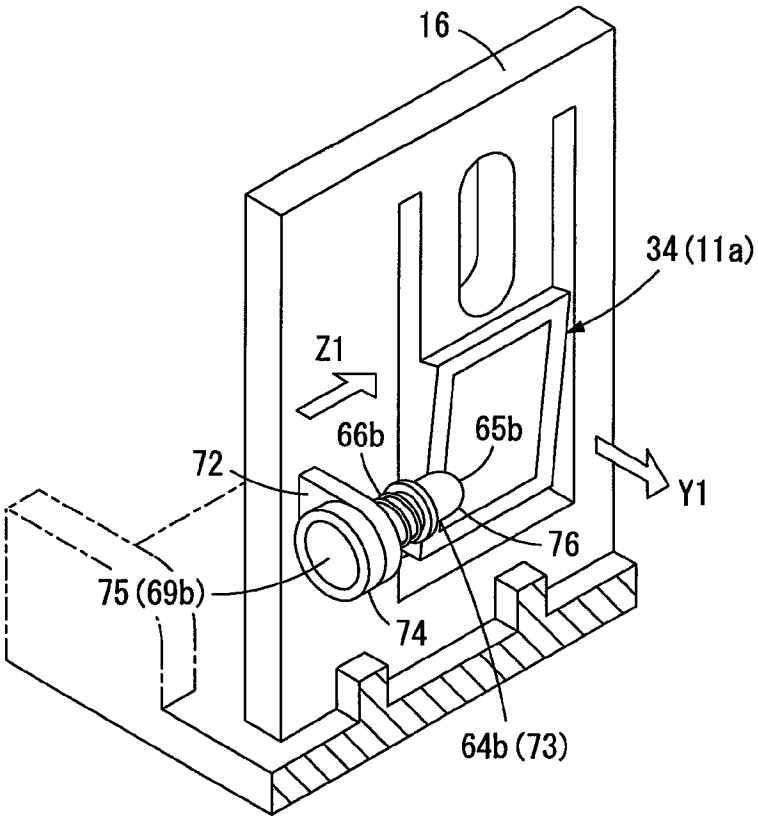
FIG. 23 shows an operation of the third embodiment of the self-lock means.
Figure 23:
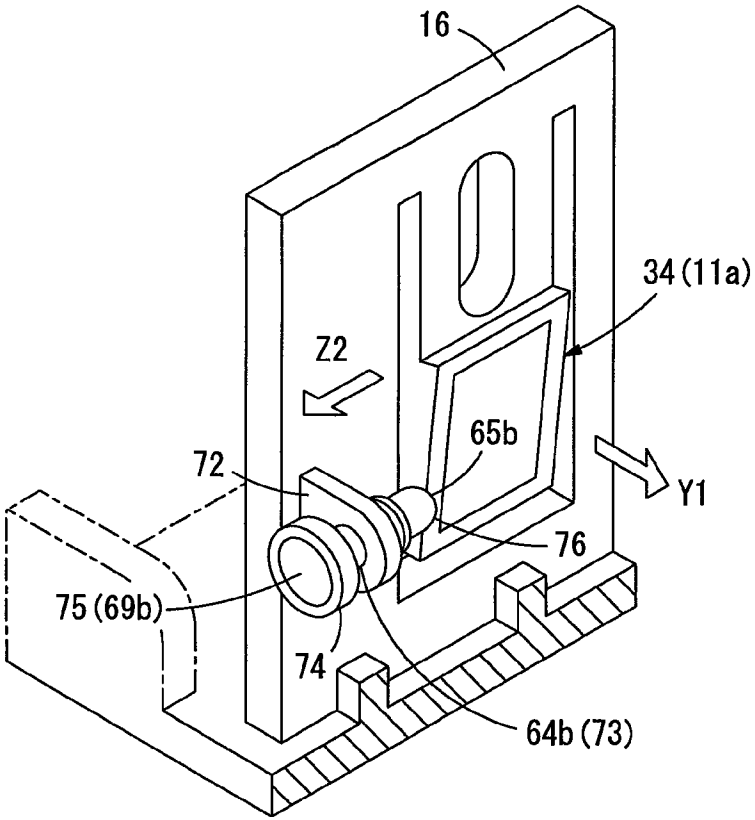
Figure 24:
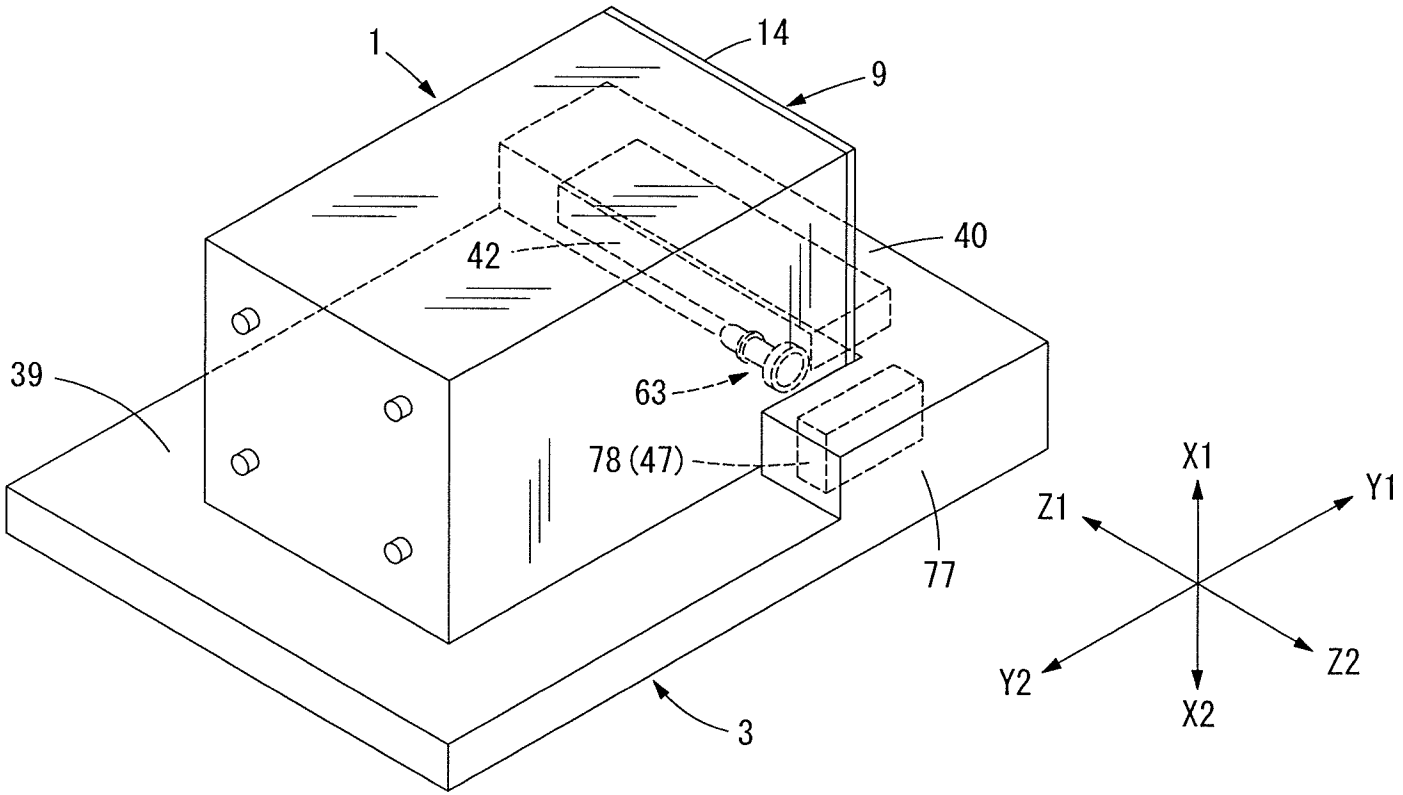
FIG. 24 is a perspective view showing a unlocking device and a product display case which is provided with the third embodiment of the self-lock means.
Figure 25:
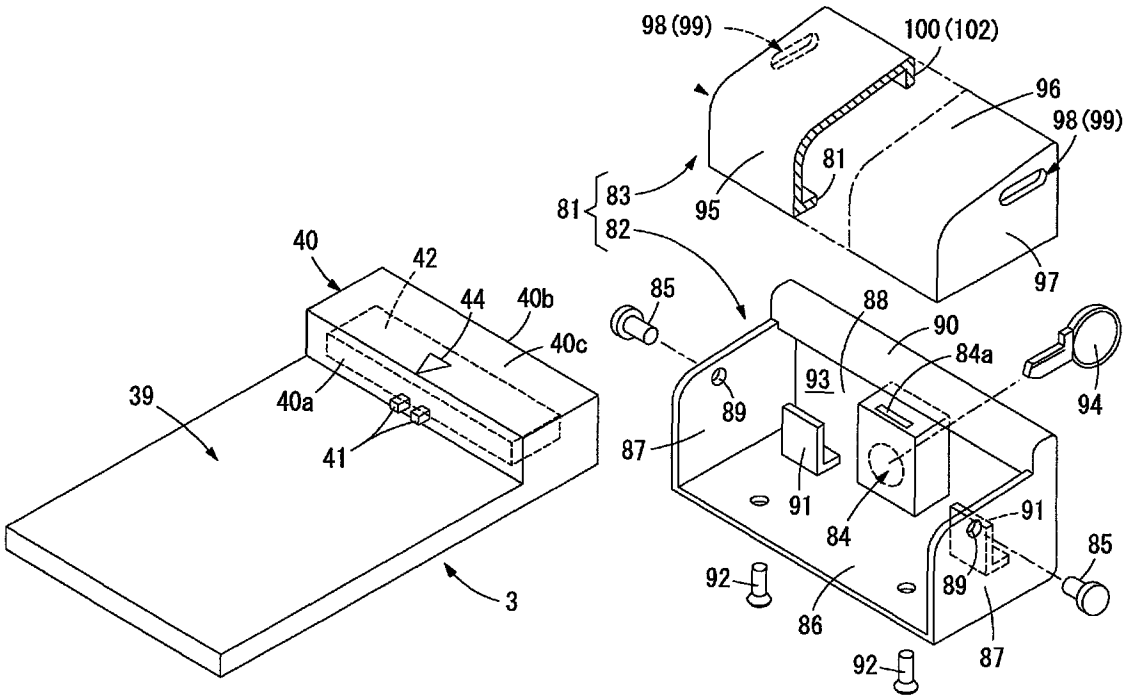
FIG. 25 is a perspective view showing a security mechanism of the unlocking device in which the unlocking device, a fixing member and a cover member are disassembled.

FIG. 22 to FIG. 24 show a third embodiment of the self-lock means. Since the first lock means 10 of projection-unlock-type and the second lock means 11 of magnet-unlock-type are same to those mentioned about the embodiment shown in FIG. 1 to FIG. 10, the same features are indicated by the same reference numerals in the drawings, and duplicate description will be omitted.

The self-lock means 63 comprises a lock member 64*b* which is provided at the vicinity of a side edge of the arm 34 which is constituted by at least one second latching member 11*a* selected among three second latching members 11*a* (one of the two second latching members 11*a* located at both sides is selected in the illustrated example). The lock member 64*b* has a pin 73 which is slidably mounted on a bracket 72 of the standing plate 16 and is movable in the Z direction (in a direction along the width of the arm 34) which intersects the Y direction and the X direction.

The pin 73 provides a head 74 at its tail which may contact to the bracket 72 and form a stopper to prevent movement of the pin 73 in a Z1 direction. The head 74 is provided with a magnetic piece 75 such as an iron piece to constitute a unlock actuator 69*b*.

A lock portion 65*b* is foamed at a tip end of the pin 73. The lock portion 65*b* moves to a locking position when the pin 73 is moved in the Z1 direction as shown in FIG. 23(A). The lock portion 65*b* moves to a unlocking position when the pin 73 is moved in a Z2 direction as shown in FIG. 23(B).

The pin 73 is being pushed in the Z1 direction by resilient support means 66*b* such as spring. Thus, the lock portion 65*b* is usually held at the locking position to prevent the arm 34 from moving in the Y1 direction. However, the lock portion 65*b* is provided with a guide surface 76 by forming its tip end in a substantially hemisphere shape. Accordingly, when the arm 34 is moved so strong to push the guide surface 76, the pin 73 may move in the Z2 direction against the resilient support means 66*b*.

Locking Operation of the Third Embodiment of the Self-Lock Means

When the case body 7*a* is moved in the X2 direction so as to cover the bottom member 4*a*, the standing plate 16 is inserted in the space 15. Then, the first lock means 10 of projection-unlock-type and the second lock means 11 of magnet-unlock-type are locked simultaneously by one quick motion as mentioned above. If the case body 7*a* is strongly depressed in the state that the standing plate 16 is inserted in the space 15, the edge of the standing plate 16 pushes the tapered guide 35*a* of the hook 35 of the arm 34 (see, FIG. 9(A)). Since the pin 73 moves in the Z2 direction with the guide surface 76 being pushed as mentioned above, the arm 34 moves in the Y1 direction and enters in the opening 36. The arm 34 returns in the Y2 direction, then the pin 73 is also returned in the Z1 direction by the resilient support means 66*b*.

Thus, the lock portion 65*b* stays in the locking position and prevents the arm 34 from moving in the Y1 in the state that the locking mechanism is locked. This means that the arm 34 cannot move in the Y1 direction unless it receives so strong force that makes the pin 73 move in the Z2 direction against the spring force of the resilient support means 66*b*.

Unlocking Operation of the Third Embodiment of the Self-Lock Means

In order to unlock the self-lock means, a unlocking device 3 as shown in FIG. 24 is offered. In addition to the unlock-structure section 40 mentioned above, the unlocking device 3 provides an extended section 77 which may oppose to the lock-structure section 9 in the Z direction. A permanent magnet 78 is included in the extended section to form unlocking means 47.

When the locking mechanism is to be unlocked by the unlocking device 3, the display case 1 is moved in the Y1 direction by sliding the bottom member 4*a* on the table 39 of the unlocking device 3 as shown in FIG. 24. As described above with reference to FIG. 1 to FIG. 10, the unlock projection 41 pushes the operation portion 12 in the Y2 direction. Then, the first lock means 10 of projection-unlock-type is unlocked. Since the magnet piece 75 of the unlock actuator 60*b* is drawn to the magnet 78 of the extended section 77, the self-lock means 63 moves in the 72 direction against the resilient support means 66*b*. The lock portion 65*b* moves to the unlocking position, and the arm 34 is allowed to move in the Y1 direction. Then, the magnet 42 draws the magnet piece 34*a* so that the arm 34 moves in the Y1 direction and disengages the hook 35 from the opening 36. As a result, the second lock means 11 of magnet-unlock-type is unlocked.

Security Mechanism for Preventing Unauthorized Use of the Unlocking Device

According to the present invention, a security mechanism 81 is provided to cover the unlock projections 41 for preventing unauthorized use of the unlocking device 3. As shown in FIG. 25 to FIG. 28, the security mechanism 81 comprises a fixing member 82 to be attached to the bottom of the unlocking device 3, a cover member 83 connected pivotally to the fixing member 82, and fix-lock means 84 for locking the cover member 83 in a position of covering the unlocking means 3.

The fixing member 82 and the cover member 83 are formed by steel plates or the like and are connected by metal pivot axes 85 so that the security mechanism has high rigidity so as not to be collapsed easily even if is hit by a hammer or the like.

The fixing member 82 comprises a base portion 86 covering a bottom side of the unlock-structure section 40 of the unlocking device 3, brackets 87, 87 standing from both sides of the base portion 86, and a standing wall 88 standing from a rear side of the base portion 86 to cover a rear side 40*b* of the unlock-structure section 40. The brackets 87, 87 forms pivotal holes 89 in which the pivot axes 85 are supported.

In the illustrated embodiment, the standing wall 88 is bent downward in a substantially U-shape in cross section to form a covering wall 90 between the brackets 87, 87. The base portion 86 is provided with positioning pieces 91 which are located apart from the inside of the standing wall 88.

As shown in FIG. 27 (A), the standing wall 88 is positioned in such manner that the base portion 86 is aligned underneath the unlocking device 3, and the positioning pieces 91 are contacted on the rear side 40*b* of the unlock-structure section 40. Then, the base portion 86 is fixed by fastener means 92 such as screws. In the illustrated example, the fastener means 92 is screwed in the bottom of the unlock-structure section 40, the base portion 86 may be extended so that the fastener means may be screwed in the bottom of the table 39.

In the state where the fixing member 82 is attached fixedly to the unlocking device 3, a locking space 93 is formed between the rear side 40*b* and the standing wall 88, in which the fix-lock means 84 is arranged. In the illustrated embodiment, the fix-lock means 84 is mounted on the standing wall 88, but it may be mounted on the base portion 86.

The fix-lock means 84 comprises a lock, such as cylinder lock that operates by inserting and rotating a key 94 from backside of the standing wall 88, and that includes an engaging piece 84*a* which may move upward above the locking space 93 and downward in the locking space 93 upon rotation of the key.

The cover member 83 provides a front cover portion 95 to cover the front side 40*a* of the unlock-structure section 40, a upper cover portion 96 to cover the upper side of the unlock-structure section 40, and side cover portions 97 which are overlapped on the brackets 87, 87 and pivoted by the pivot axes 85 through pivotal holes 98. The pivotal hole 98 is formed in an elongated shape in a longitudinal direction of the table 39 so that the hole 98 comprises posture-alternation means 99 of the cover member 83.

The upper cover portion 96 of the cover member 83 provides its rear end portion with locking means 100 which may be engaged with the engaging piece 84*a* when the locking means 100 enters in the locking space 93. The front cover portion 95 provides its lower end portion with destructing means 101 which enters below the unlock projections 41. In the illustrated example, the locking means 100 is formed by bending a rear edge of the upper cover portion 96 downward, and the destructing means 101 is formed by bending a lower edge of the front cover portion 95 laterally toward the front side 40*a*.

The fixing member 82 and the cover member 83 are connected in such manner that the side cover portions 97, 97 are overlapped inside of the brackets 87, 87 to meet their pivotal holes 89, 98 mutually, and then the pivot axes 85, 85 are inserted. It is not illustrated, but the pivot axes 85, 85 are prevented from being pulled out by adding caulking or the like on its insertion end.

The security mechanism 81, in which the cover member 83 is pivoted to the fixing means 82, and the base portion 86 is fixedly attached to the bottom of the unlocking device 3 by the fastener means 92, makes the unlocking device 3 to be in a usable state and in a non-usable state selectively by opening and closing the cover member 83.

Figure 26A:
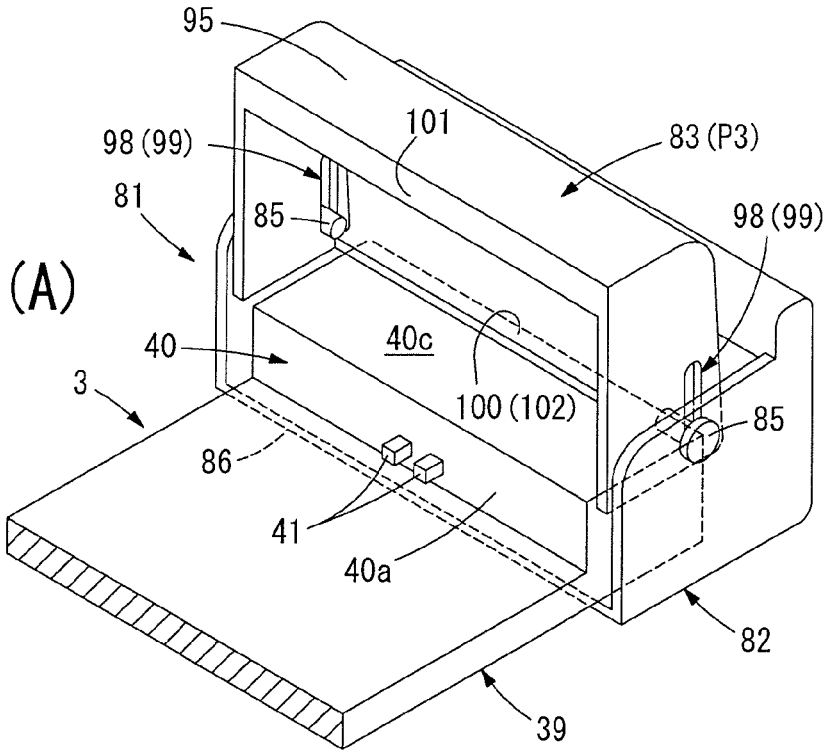
FIG. 26 shows conditions of use of the security mechanism.
Figure 26B:
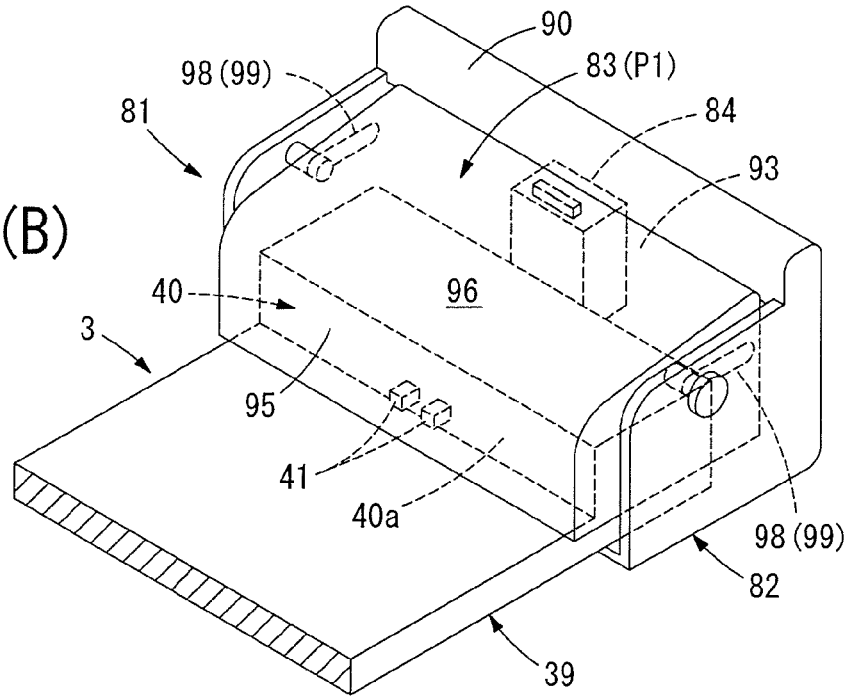
Figure 27A:
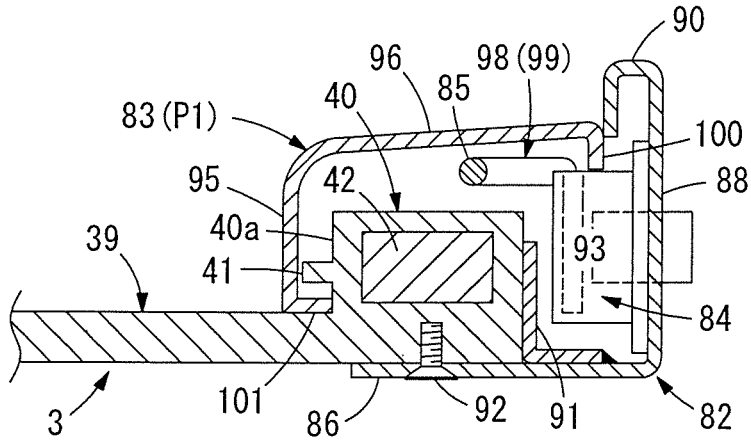
FIG. 27 shows change of the postures of the cover member.
Figure 27B:
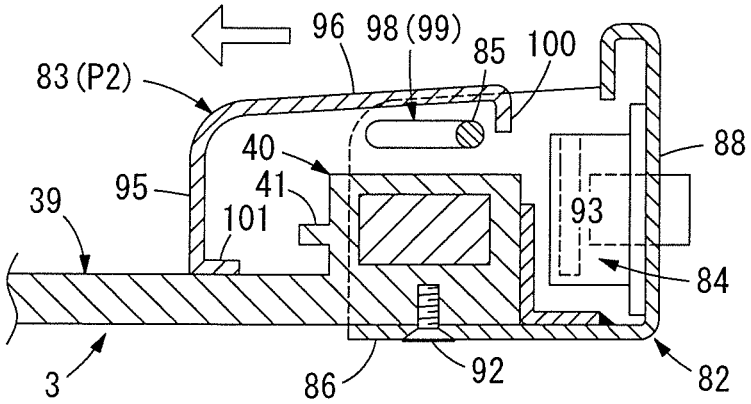

The posture of the cover member 83 may be selectively changed to: a closed posture P1 (see FIG. 27(A) and FIG. 26(B)) in which the destructing means 101 is made to advance under the unlock projections 41, and the locking means 100 is made to face the locking space 93; a standby posture P2 for opening and closing (see FIG. 27(B)) in which the destructing means 101 is moved out from underneath the unlock projections 41, and the locking means 100 is moved out the locking space 93; and an opened posture P3 (see FIG. 27 (C) and FIG. 26 (A)) in which the front cover portion 95 stands up to open the front side 40*a*. Such posture change is enabled by the posture-alteration means 99 which is constituted, in the illustrated embodiment, by the pivotal hole 98 in an elongated shape. The cover member 83 may move between the closed posture P1 and the standby posture P2 along the elongated pivotal hole 98 through which the pivot axis 85 is inserted as shown in FIG. 27 (A) and FIG. 27 (B), and may rotate to the opened posture P3 about the pivot axes 85 from the standby posture P2 as shown in FIG. 27 (C).

When the cover member 83 is made to position in the closed posture P1, the front side 40*a* including the unlock projections 41 is covered by the front cover portion 95 so that the unlocking device 3 does not carry out a function for unlocking the lock of the product display case 1. When the engaging piece 84*a* of the fix-lock means 84 is made to project by key 94 in the state of the closed posture P1, the engaging piece 84*a* engages with the locking means 100 so that the cover member 83 is locked so as not to move toward the standby posture P2 as shown in FIG. 28(A). As a result, the unlocking device 3 does not have a unlocking function, unless said lock is canceled by the key 94. The cover member 83 is prevented from being moved upward by making the destructing means 101 advance under the unlock projections 41. If a thief moves the cover member 83 upward by force, the destructing means 101 breaks the unlock projections 41. Accordingly, when the cover member 83 is moved upward by force and the front side 40*a* of the unlock-structure section 40 is opened, the unlock projections 41 are broken so that the unlocking device 3 is no longer used for unlocking the lock of the product display case 1.

When the unlocking device 3 is to be used, the engaging piece 84*a* of the fix-lock means 84 is disengaged with the locking means 100 by the key 94, and the cover member 83 is moved to a position of standby posture P2 and then rotated to a position of opened posture P3. Then, the front side 40*a* of the unlock-structure section 40 becomes wide opened; it can be used for unlocking the lock of a product display case 1. When changing the posture of the cover member 83 from the opened posture P3 to the closed posture P1, an operation contrary to the above is performed.

Figure 27C:
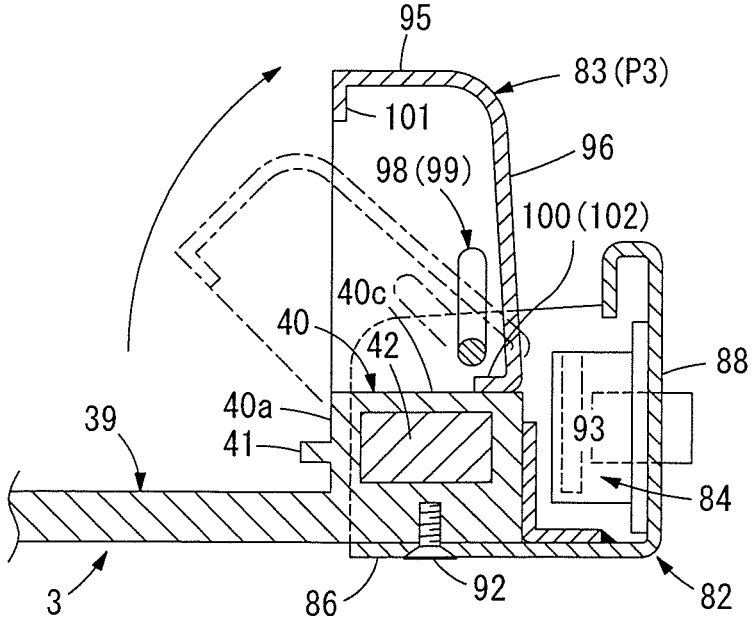
Figure 28:
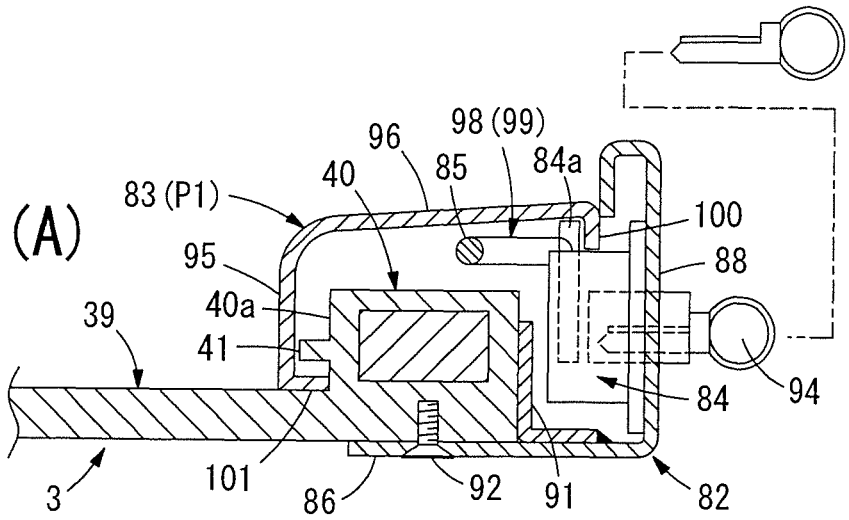
FIG. 28 shows an operation of the security mechanism.
Figure 28:
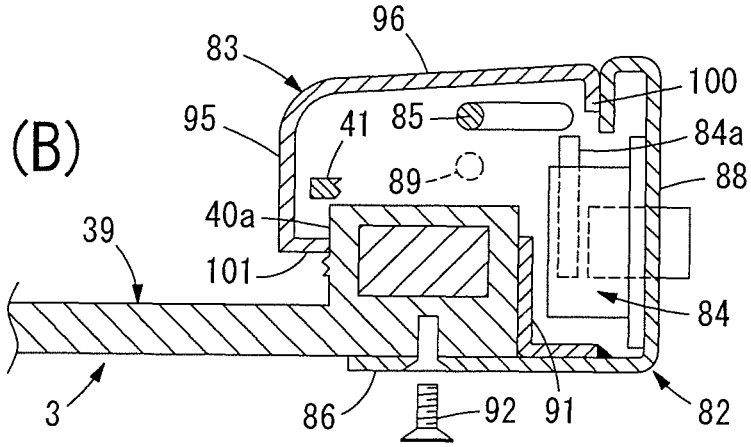
Figure 28:
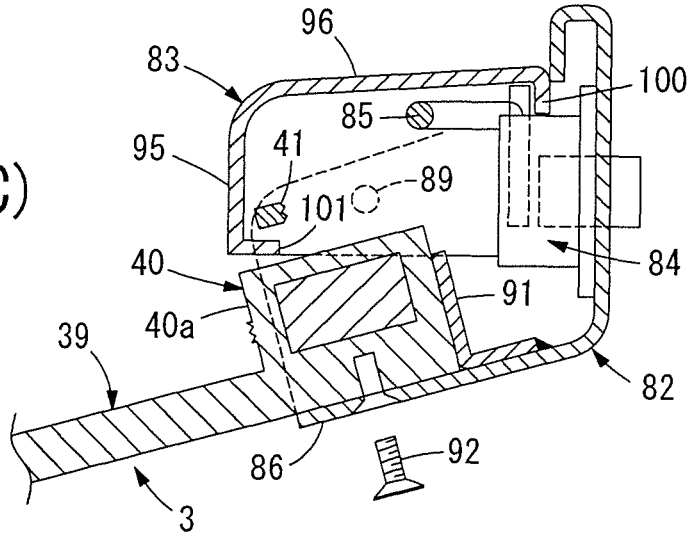

It is preferred to provide the locking mechanism 100 with a holding seat 102 which may be laid on the upper surface 40*c* of the unlock-structure section 100 to keep the cover member 83 standing in the opened posture P3 as shown in FIG. 27(C).

The security mechanism 81 of the invention makes it possible that the unlocking device 3 is selected between a usable condition and a non-usable condition by managing the key 94 at an authorized salesclerk. The cover member 83 may be fixed in the closed posture P1 and locked by the fix-lock means 84 when the store is closed for example.

A theft group may trespass upon a store at midnight, and they may steal the unlocking device 3 in which the cover member 83 is in the fixed lock condition.

Since the security mechanism 81 and the unlocking device 3 are secured by the fastener means 92 at the bottom, the thief may try to remove the fastener means 92. Even if the removable of the fastener means 92 is succeeded, however, the security mechanism 81 surrounds the unlock-structure section 40 of the unlocking device 3 from both the upper and lower sides with the cover member 83 and the fixing member 82. The front and rear sides 40*a*, 40*b* of the unlock-structure section 40 are caught between the destructing means 101 and the positioning piece 91. The destructing means 101 enters underneath the unlock projections 41 and prevents upward movement of the cover member. When the thief tries to open the cover member 83 by deforming or cutting the pivot axes 85 and pulling the unlocking device 3 apart downward from the cover member 83, the unlock projections 41 will be broken and destroyed by the destruction means 101 as shown in FIG. 28(B).

When the thief tries to pull the unlocking device 3 from the security mechanism 81 by deforming the base portion 86 of the fixing member 82 with tools, the unlocking device 3 is also pulled apart downward from the cover member 83 as shown in FIG. 28(C), the unlock projections 41 will be broken and destroyed by the destruction means 101.

As a result, the unlocking device 3 can no longer be used for unlocking the lock of a product display case 1. No criminal use for stealing goods will happen.

What is claimed is:

1. An antitheft device for a product display case comprising a product display case (1) provided with a locking mechanism (2) and a unlocking device (3) for unlocking said locking mechanism wherein;

said product display case (1) includes a first case component (4) and a second case component (7), both case components being openably closed to be fitted together to form a product holding chamber (6), and a receiving portion (18) being provided in the product display case to which a security tag (17) is attached, said locking mechanism (2) provides a first lock (10) of projection-unlock type and second lock (11) of magnet-unlock type which are arranged in a lock-structure section (9) of the case, wherein said first lock (10) carries out its locking operation in a direction toward outside the display case, and said second lock (11) carries out its locking operation in a direction toward inside the display case, when said both case components are closed and fitted together, said first lock (10) comprises a first latching member (10*a*) and a first receiving member (10*b*) that are provided between said first and second case components, wherein said first latching member (10*a*) may be resiliently moved in said directions toward outside and inside of the display case, and said first receiving member (10*b*) opposes against said first latching member (10*a*) to catch it, and wherein said first latching member (10*a*) has an operation portion (12) for receiving a pushing force which may be exerted from outside the lock-structure section, said second lock (11) comprises a second latching member (11*a*) and a second receiving member (11*b*) that are provided between said first and second case components, wherein said second latching member (11*a*) may be resiliently moved in said directions toward outside and inside of the display case, and said second receiving member (11*b*) opposes against said second latching member (11*a*) to catch it, and wherein said second latching member (11*a*) includes a magnetic piece (34*a*) which may be attracted to a magnet put close to the lock-structure section from outside, and said unlocking device (3) comprises a table (39) and a unlock-structure section (40), wherein said table (39) may receive the product display case (1) so that the lock-structure section (9) may slide forward and backward with respect to said unlock-structure section (40), and said unlock-structure section (40) provides a unlock projection (41) directed to said operation portion (12) of the first lock (10) and a magnet (42) directed to said magnetic piece (34*a*) of the second lock (11).

2. An antitheft device for a product display case according to claim 1 wherein;

said first case component (4) is constituted by a bottom member (4*a*), and said second case component (7) is constituted by a case body (7*a*) provided with an opening (5) underneath thereof so that the case body (7*a*) may form said holding chamber (6) visible from outside when said opening (5) is closed by said bottom member (4*a*), said lock-structure section (9) comprises a pair of inner and outer plates (13)(14) provided in the case body (7*a*), a space (15) formed between the inner and outer plates (13) (14), and a standing plate (16) extended upward from the bottom member (4*a*) so as to be inserted in said space when the bottom member (4*a*) closes said opening (5), said first latching member (10*a*) and said first receiving member (10*b*) of the first lock (10) are provided between the outer plate (14) and the bottom member (4*a*), and said second latching member (11*a*) and said second receiving member (11*b*) of the second lock (11) are provided between the inner plate (13) and the standing plate (16).

3. An antitheft device for a product display case according to claim 2 wherein;

said second latching member (11*a*) of the second lock (10) provides the standing plate (16) with an arm (34) having a hook (35) protruding in the direction toward inside the display case so that the arm (34) may be resiliently rocked in said directions toward outside and inside the display case, and said second receiving member (11*b*) provides the inner plate (13) with an opening (36) which may catch the hook (35) to be latched together.

4. An antitheft device for a product display case according to claim 2 or 3 wherein;

said first latching member (10*a*) of the first lock (10) is constituted by a movable member (46) having an engaging portion (29) which is separated from inside of the outer plate with a gap (29*a*) and may be resiliently moved forward and backward in the directions toward outside and inside the display case, said first receiving member (10*b*) is constituted by a hook-like member (31) standing up at an end portion (4*b*) of the bottom member (4*a*) so that the hook-like member (31) may be inserted in the gap (29*a*) and catches the engaging portion (29), said movable member (46) is provided with an operation portion (12), and said outer plate (14) is provided with an entrance (27) directing to said operation portion (12) so that the unlock projection (41) of the unlocking device (3) may enter the entrance (27).

5. An antitheft device for a product display case according to claim 2 or 3 wherein;

said outer plate (14) is attached detachably to the case body (7*a*) and an attachment portion (18) is formed at an inside thereof to which the security tag (17) is attached.

6. An antitheft device for a product display case according to claim 1, 2, or 3 wherein;

a permanent locking device (60) is provided which locks said second lock so that the second latching member (11*a*) is prevented from disengaging from the second receiving member (11*b*) when a tool is inserted through a space (S) of the lock-structure section and pushes the second latching member (11*a*) to be rocked in the state that the first and second case components (4) (7) are fitted together.

7. An antitheft device for a product display case according to claim 6 wherein;

the second latching member (11*a*) is provided with an arm (34) which may rock in the directions toward outside and inside of the display case and provides a hook (35) protruding in a direction toward inside of the display case, and the second receiving member (11*b*) is provided with an opening (36) for receiving a hook (35) of the arm (34) to engage, wherein said permanent locking device (60*a*) comprises a projection (59) which engages said arm (34) and said opening (36) with each other so that the arm (34) is prevented from disengaging from the opening, when the arm is pushed to be rocked by an inaccurate tool.

8. An antitheft device for a product display case according to claim 6, wherein;

the second latching member (11*a*) is provided with an arm (34) which may rock in the directions toward outside and inside of the display case and provides a hook (35) protruding in a direction toward inside of the display case, and the second receiving member (11*b*) is provided with an opening (36) for receiving a hook (35) of the arm (34) to engage, wherein said permanent locking device (60*b*) comprises a fragile hinge portion (57) which may form breakage (63) and prevent the arm (34) from disengaging from the opening, when the arm is pushed to be rocked by an inaccurate tool.

9. An antitheft device for a product display case according to claim 6, wherein;

the second latching member (11*a*) is provided with an arm (34) which provides an interrupting wall (54) underneath the arm (34), a lower end of the arm (34) is positioned outside of said interrupting wall (54), and a guide surface (58) is formed which inclines toward outside the display case from its lower end to its upper portion.

10. An antitheft device for a product display case according to claim 1, 2, or 3 wherein;

said second lock (11) of magnet-unlock-type is provided with a self-lock device (63) having a lock member (64) which is resiliently movable between a locking position where the lock member (64) prevents the second latching member (11*a*) from rocking toward outside the display case and a unlocking position where the lock member (64) allows the second latching member (11*a*) to rock toward outside the display case and which keeps said locking position, and said unlocking device (3) provides the unlock-structure section (40) with unlocking member (47) which moves said lock member (64) of the self-lock device (63) to said unlocking position.

11. An antitheft device for a product display case according to claim 10 wherein;

said self-lock device (63) provides pair of lock members (64) (64) at both sides of the second latching member (11*a*) of the second lock (11), said lock members (64) (64) include lock portions (65) which are movable between said locking position and said unlocking position, and resilient support members (66) (66) which hold said lock portions (65) respectively at the locking position, and said operation portion (12) of the first lock (10) is provided with a unlock actuator (69) which extends toward inside the display case, whereby said unlock actuator (69) moves a pair of resilient support members (66) (66) to be apart from each other so that the lock portions (65) may move to the unlocking position, when said operation portion (12) is moved toward inside the display case by the unlock projection (41) of the unlock-structure section (40).

12. An antitheft device for a product display case according to claim 10 wherein;

said self-lock device (63) provides a lock member (64*a*) which opposes to the second latching member (11*a*) of the second lock (11), and said lock member (64*a*) includes a lock portion (65*a*) which is movable between a locking position and a unlocking position, a resilient support member (66*a*) which moves said lock portion (65*a*) toward the locking position, and a unlock actuator (69*a*) which makes said lock portion (65*a*) move to said unlocking position when the unlock actuator (69*a*) is pushed toward inside the display case, whereby said unlock actuator (69*a*) may be moved by the unlock projection (41) of the unlock-structure section (40) against the resilient support member (66*a*).

13. An antitheft device for a product display case according to claim 10 wherein;

said self-lock device (63) provides a lock member (64*b*) which is directed to a side-edge of the second latching member (11*a*) of the second lock (11), said lock member (64*b*) includes a lock portion (65*b*) which is movable between a locking position and a unlocking position, a resilient support member (66*b*) which moves said lock portion (65*b*) toward the locking position, and a unlock actuator (69*b*) having a magnetic piece (75) which makes said lock portion (65*b*) move to the unlocking position against the resilient support member when a magnet is approached to said magnetic piece to be drawn toward the unlocking position, and said unlocking device (3) provides an extended section (77) which includes a magnet (78) to be approached to said magnetic piece (75) of the self-lock device (63).

14. An antitheft device for a product display case according to claim 1 wherein;

said unlocking device (3) is provided with a security mechanism (81) which comprises a fixing member (82) secured to a bottom of the unlocking device (3) by a fastener, a cover member (83) which is connected to said fixing member via pivotal axes (85) so as to be opened and closed, and a fix-lock (84) which may engage the cover member and fixing member with each other, said cover member (83) is so constructed to change its posture between a closed posture (P1) and an opened posture (P3) so that at least a front side (40*a*) including the unlock projection (41) of the unlocking device (3) is closed and opened thereby, and the cover member (3) may be fixed by the fix-lock (84) in the closed posture (P1), and said cover member (83) is provided with a destructing member (101) which enters underneath the unlock projection (41) when the cover member (83) is positioned in the closed posture (P1), thereby the unlock projection (41) may be destroyed by the destructing member (101) when the unlocking device (3) is forced to move downward from the cover member (83) in the state that the fix-lock (84) fixes the cover member (83).

15. An antitheft device for a product display case according to claim 14 wherein;

said cover member (83) is provided with a holding seat (102) which may be laid on an upper surface (40*c*) of the unlock-structure section (40) and keeps the cover member (83) standing in the opened posture (P3) when the cover member is positioned in the opened posture (P3).

* * * * *